US005125567A

United States Patent [19]

McClure

[11] Patent Number: 5,125,567

[45] Date of Patent: Jun. 30, 1992

[54] CONTAINER MADE FROM ONE-PIECE BLANK

[75] Inventor: Jack A. McClure, Garden City, Kans.

[73] Assignee: Inland Container Corporation, Indianapolis, Ind.

[21] Appl. No.: 615,703

[22] Filed: Nov. 20, 1990

[51] Int. Cl.[5] ..... B65D 5/22

[52] U.S. Cl. ..... 229/150; 229/117.17; 229/174

[58] Field of Search ..... 229/149, 150, 174, 175, 229/141, 165, 117.13, 117.17

[56] References Cited

U.S. PATENT DOCUMENTS

| | | | |
|---|---|---|---|
| 1,207,899 | 12/1916 | Greve . | |
| 1,281,768 | 10/1918 | Craig | 229/174 |
| 2,022,906 | 12/1935 | Weeks | 229/150 |
| 2,658,660 | 11/1953 | Keller | 229/150 |
| 2,665,050 | 1/1954 | Baumann | 229/174 |
| 2,857,090 | 10/1958 | Fallert . | |
| 3,228,710 | 1/1966 | Chodorowski . | |
| 3,410,475 | 11/1968 | Wagner | 229/174 |
| 3,734,392 | 5/1973 | Clark | 229/174 |
| 3,899,123 | 8/1975 | Stollberg et al. . | |
| 3,933,300 | 1/1976 | Dempster | 229/149 |
| 4,017,019 | 4/1977 | Booth | 229/149 |
| 4,055,293 | 10/1977 | Stramaglia | 229/175 |
| 4,056,223 | 11/1977 | Williams . | |
| 4,082,215 | 4/1978 | Eichenauer | 229/178 |
| 4,129,247 | 12/1978 | McCall . | |
| 4,236,740 | 12/1980 | Sorenson et al. | 229/149 |
| 4,239,148 | 12/1980 | Sorenson et al. | 229/149 |
| 4,244,507 | 1/1981 | Garmon . | |
| 4,353,496 | 10/1982 | Nelson, Jr. et al. | 229/178 |
| 4,621,766 | 11/1986 | McClure . | |
| 4,676,428 | 6/1987 | McClure . | |
| 4,676,429 | 6/1987 | Crowe et al. | 229/178 |
| 4,883,221 | 11/1989 | Brundage | 229/174 |

*Primary Examiner*—Stephen Marcus
*Assistant Examiner*—Christopher J. McDonald
*Attorney, Agent, or Firm*—Fitch, Even, Tabin & Flannery

[57] ABSTRACT

A carton with triple-thickness sidewalls formed from a one-piece unitary blank includes sidewalls and endwalls extending from a floor. Lid members extending from the endwalls cover the carton interior and arrangements for locking the lids in a closed position is provided. The sidewalls and endwalls are interlocked with a locking post arrangement to prevent pull-out.

8 Claims, 17 Drawing Sheets

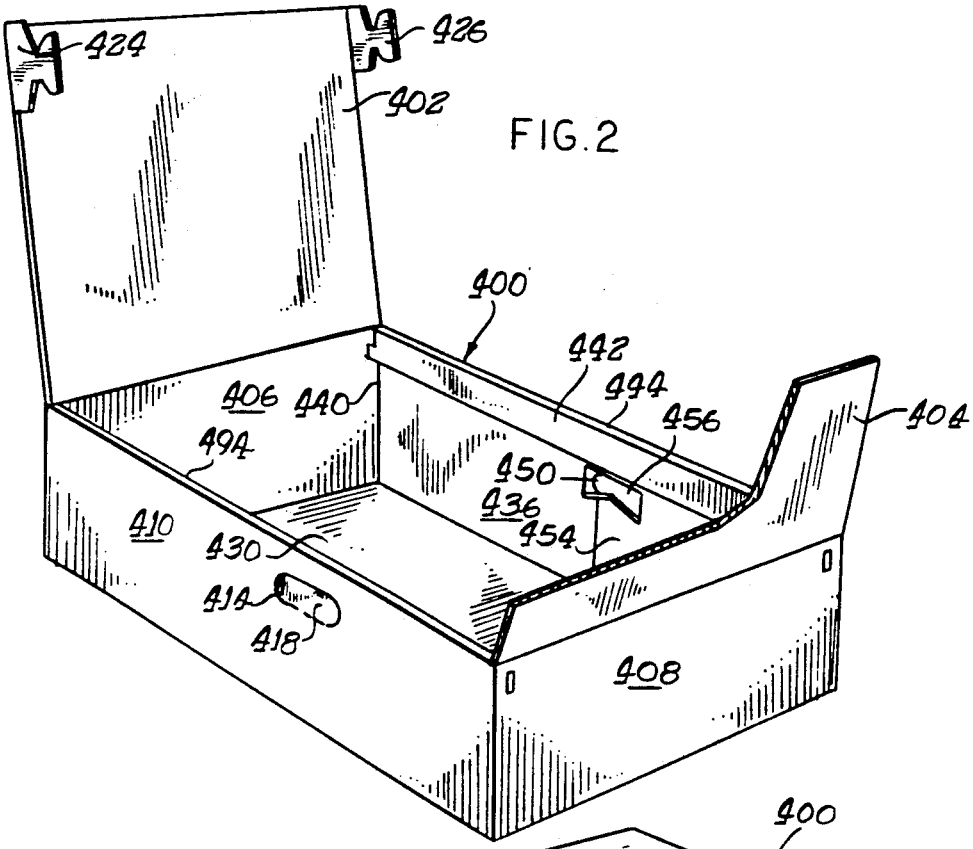
FIG. 2
FIG. 1
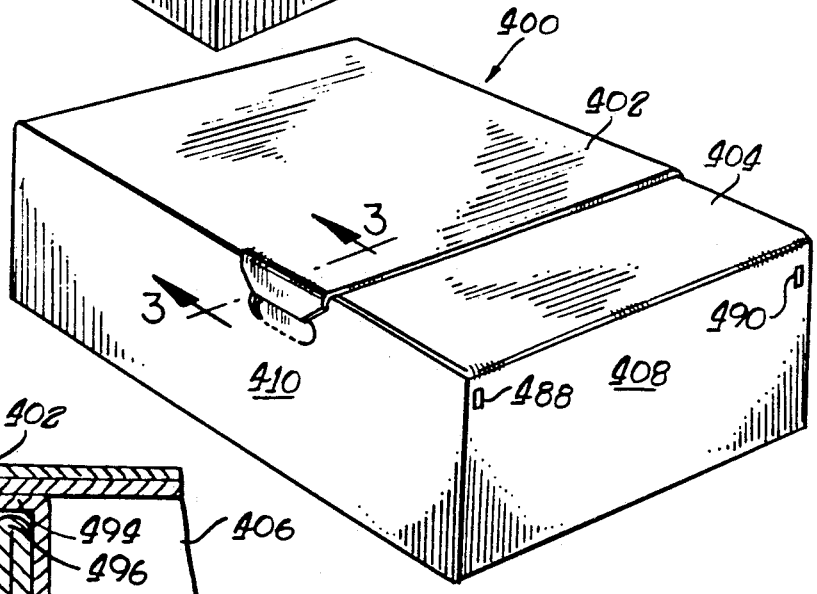
FIG. 3
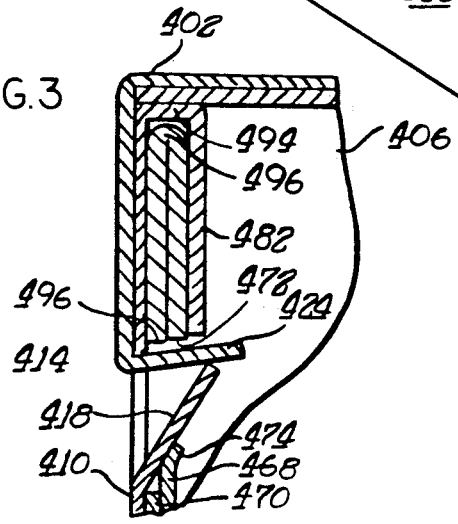

CONTAINER MADE FROM ONE-PIECE BLANK

BACKGROUND OF THE INVENTION

1. Field of the Invention

The present invention pertains to containers of the type which are constructed without adhesive by folding a one-piece blank of corrugated cardboard or other suitable material.

2. Description of the Related Art

Many users of cartons made from corrugated cardboard and the like material who operate mass production facilities prefer to receive shipping cartons in an unassembled or "knocked-down" condition. Further, certain economies of carton manufacture can be obtained if the carton is constructed from a unitary blank. Accordingly, such cartons may be supplied to customers in the form of a stack of sheet-like carton blanks which are stacked on a pallet. Palletized carton blanks are attractive to a carton user since a large number of cartons can be erected from a palletized load and the pallets can be located close to a production line since they require a minimum of space. It is important however, that such cartons be quickly and easily erected so as to coordinate with the rate of production of the products to be stored in the cartons.

One example of a mass production application for palletized cartons is found in the meat packing industry. Such cartons are used to transport cuts of meat to a nearby freezing area, or frozen meat cuts can be placed directly into the cartons. As mentioned, the cartons, if they are to be useful in a mass production, high production rate environment must be quickly and easily erected from the flat blank.

It is generally preferred that adhesive be avoided in the erection of the carton blanks, since the use of adhesive slows the erection process, both in application of the adhesive and in the time required for the adhesive to cure or set. Further, carton users prefer cartons which are erected without adhesive since adhesive requires additional machinery located proximate to the assembly line, where space is at a premium. Further, if adhesive can be avoided in the carton erection, additional control practices required in the food processing industries can be avoided.

Cartons used for packaging meat cuts and other high density (and therefore heavy) products must, even though erected without adhesive, be strong enough to withstand relatively high loadings. Further, cartons used in the meat packing industry and in many other industries are loaded in bulk onto box cars and trucks, by being stacked one on top of another. The loading on the lower level of cartons can at times be quite high. It is important that cartons successfully withstand the rigors of conventional shipping practices if losses to the carton users are to be avoided.

SUMMARY OF THE INVENTION

It is an object of the present invention to provide a carton having triple layer sidewalls which is constructed from a unitary blank and which is quickly and easily erected without the use of adhesives, staple fasteners and the like fasteners.

Another object according to the present invention is to provide a carton of the above-described type having abutting sidewall layers which are interlocked with one another and which are overlain by a unitary outer sidewall layer which extends between the carton endwalls.

Another object according to the present invention is to provide a carton having opposed, partly overlying lid members, with the uppermost lid member carrying a pair of locking tabs received between the sidewall layers and locked in a closed position by locking edges in the sidewall layers.

Another object according to the present invention is to provide a carton of the above-described type having a locking beam extending across the abutting sidewalls which is held in place by end portions engaging the carton endwalls.

A further object according to the present invention is to provide cartons and carton blanks of the above-described type which are suitable for use in the food processing industries, which have an inner layer between the hand holes and the carton interior and which have lids which will not pop into the carton interior when pushed.

Yet another object according to the present invention is to provide a carton and a carton blank capable of withstanding relatively high loadings, and which can be economically constructed from a carton blank of minimum size.

These and other objects according to the present invention which will become apparent from studying the appended description and drawings are provided in a carton comprising:

a floor panel having two pairs of opposed sides;

a pair of opposed endwall panels hingedly connected to one pair of opposed sides of said floor panel, the endwall panels each having opposed sides;

lid panels in serial succession with said end wall panels and said floor panel and hingedly connected to said endwall panels along hinge lines;

two pairs of intermediate sidewall panels hingedly connected to the remaining pair of opposed sides of said floor panel;

outer side wall panels extending between said endwall panels;

two pairs of inner sidewall panels, each coupled to a respective intermediate sidewall panel to form a sidewall subassembly, one subassembly at each side of each endwall.

BRIEF DESCRIPTION OF THE DRAWINGS

In the drawings, wherein like elements are referenced alike:

FIG. 1 is a perspective view of a first carton embodiment illustrating aspects according to the present invention;

FIG. 2 is a perspective view thereof with the carton flaps opened;

FIG. 3 is an enlarged fragmentary cross-sectional view taken along the line 3—3 of FIG. 1;

DETAILED DESCRIPTION OF THE PREFERRED EMBODIMENTS

Figure 4:
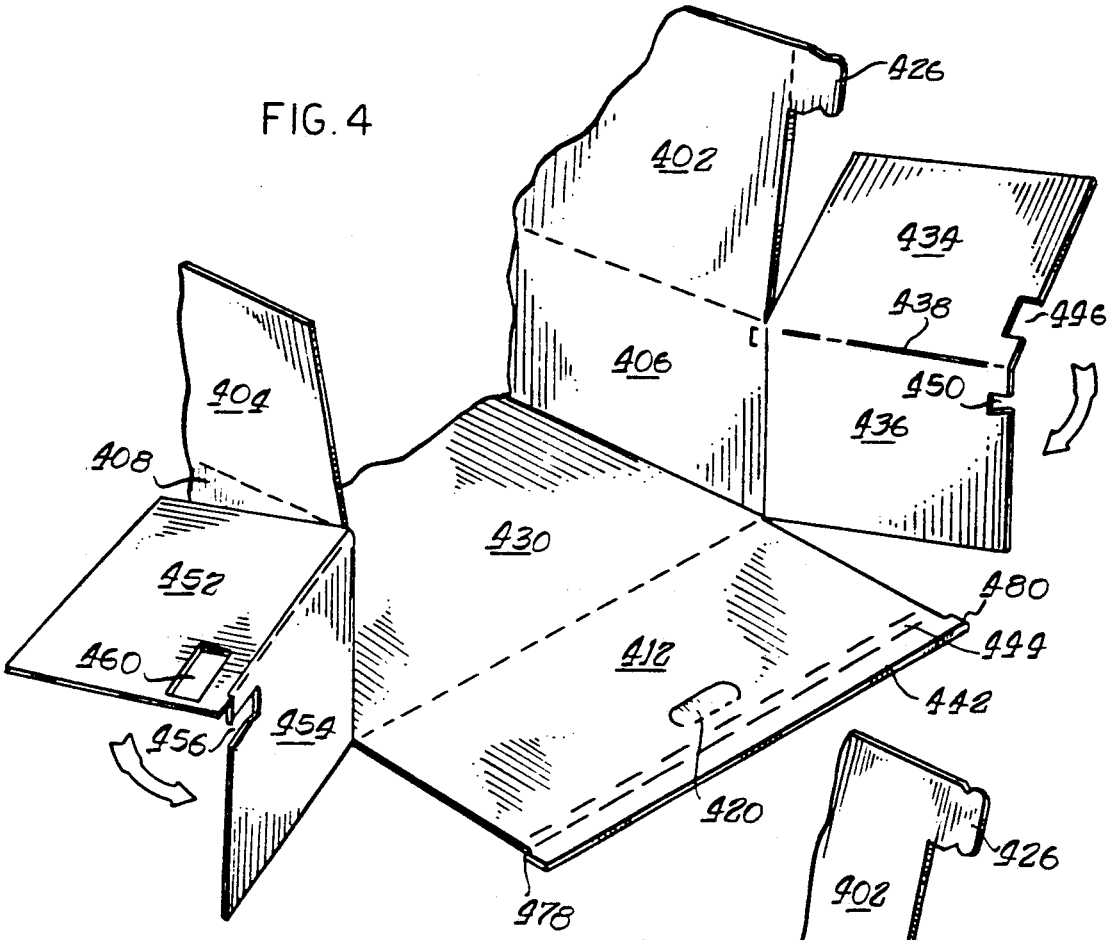
FIGS. 4 and 5 are fragmentary perspective views illustrating the erection of the carton blank.
Figure 5:
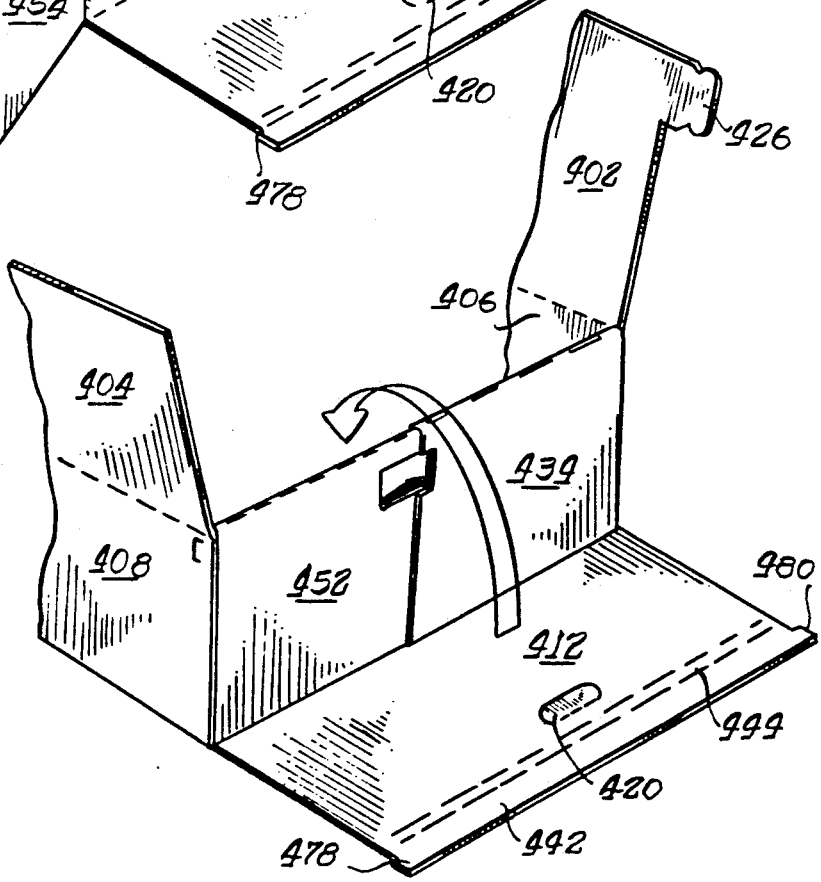

Referring now to the drawings, and initially to FIGS. 1-6, a first embodiment of a carton constructed according to principles of the present invention is generally illustrated at 400. The carton 400 has found immediate commercial application in the meat packing industry, and has the necessary strength to accommodate relatively heavy meat cuts. The carton 400 is fully erected without the use of adhesives, staples or the like fasteners.

The carton 400 employs interlocking portions of a unitary carton blank to maintain the configuration illustrated in the figures. As will be seen herein, the interlocking of the various carton portions and the overall proportion of the carton is maintained despite stacking loadings when several cartons are placed one on top of another, as is common when shipping via box car or by semi-trailer.

Figure 7:
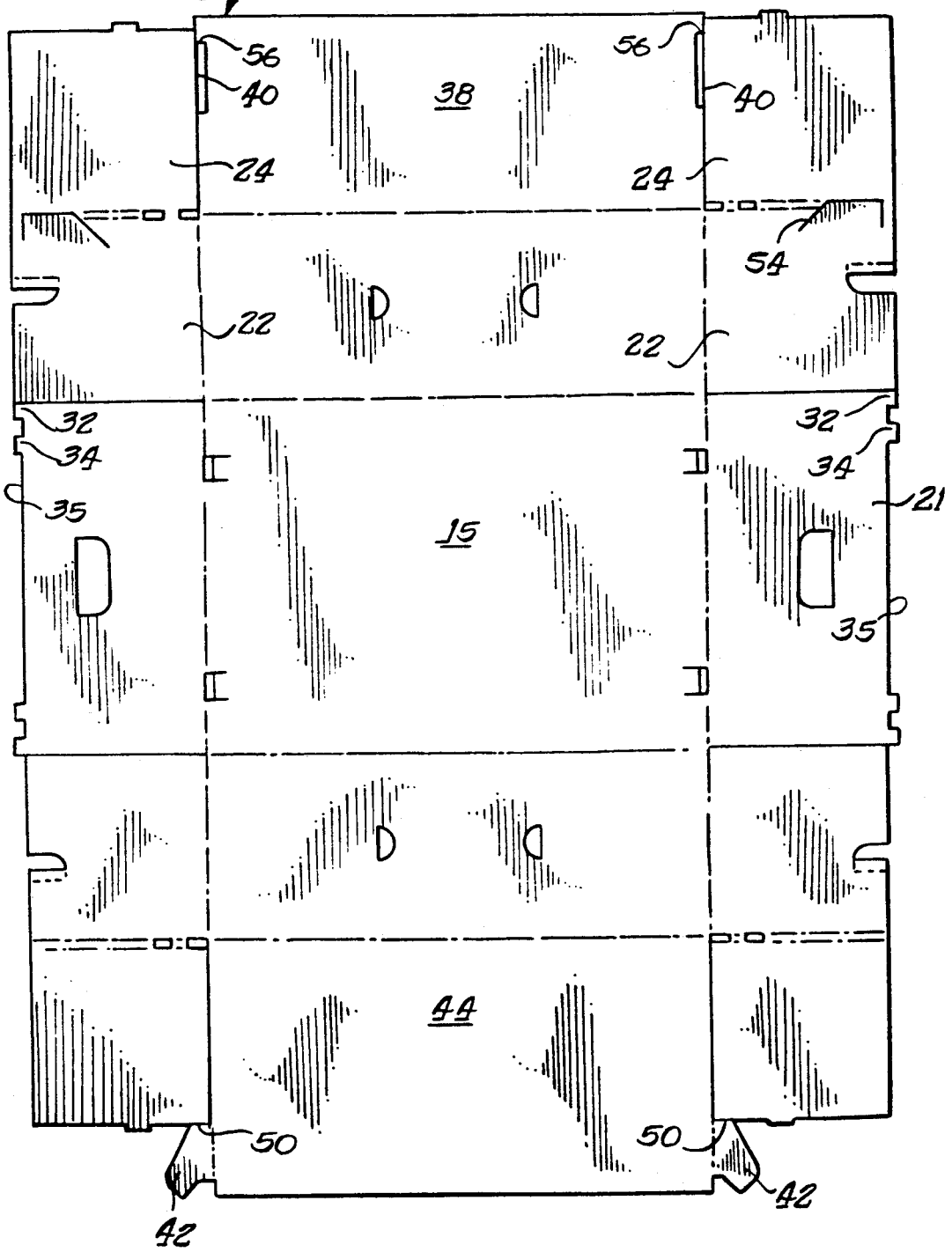
FIG.7 (PRIOR ART)
FIG. 7 is a plan view of a prior art carton blank.
Figure 8:
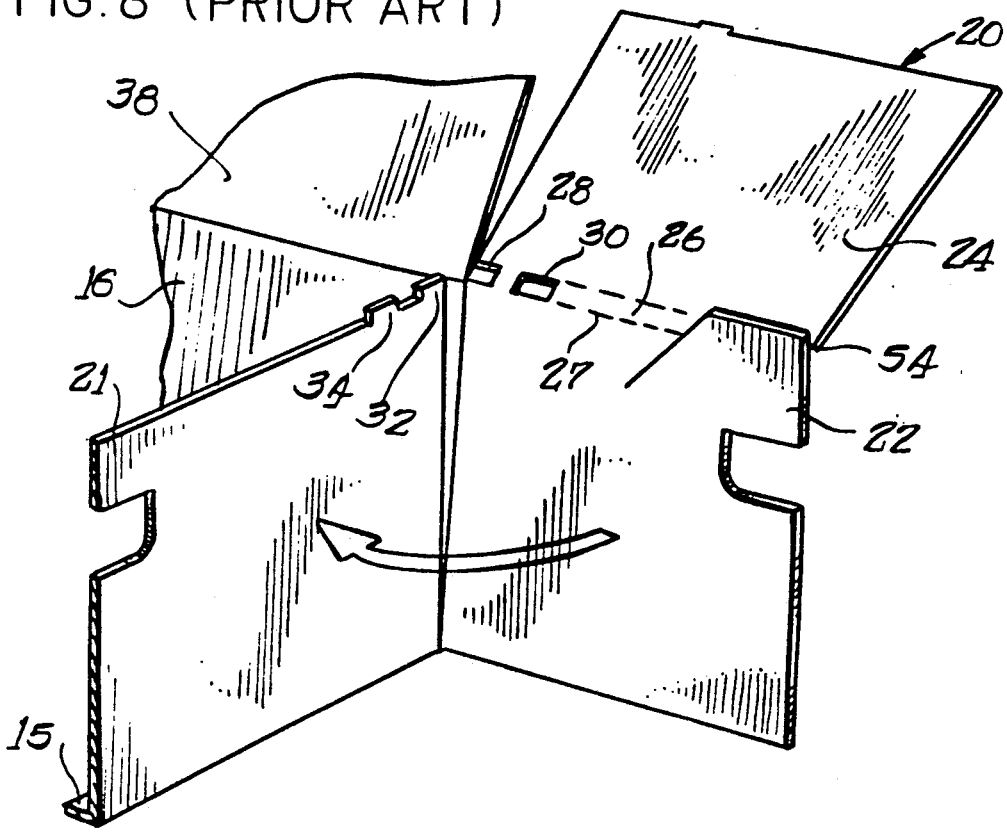
FIG. 8 (PRIOR ART)
FIG. 8 is a fragmentary perspective view of the blank of FIG. 7, shown partly assembled.
Figure 9:
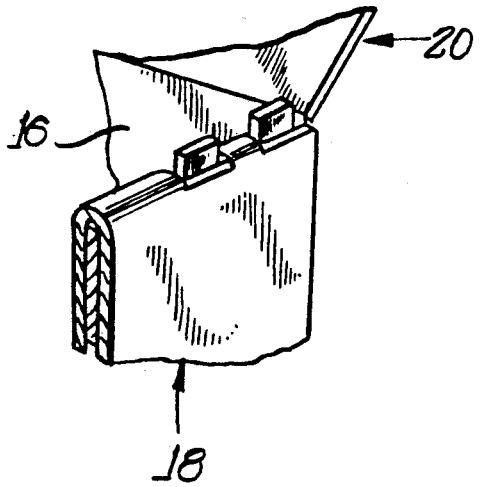
FIG. 9 (PRIOR ART)
FIG. 9 shows a portion of the carton of FIG. 8 in an assembled condition.

Before proceeding with a detailed description of carton 400, attention will be directed to a prior art carton 20 illustrated in FIG. 9 which is also constructed from a unitary paper board blank, the blank 21 of FIG. 7, without using adhesives or fasteners. The paper board blank 21 from which the prior art carton 20 is constructed is illustrated in FIG. 7 and a fragmentary view of one end of the carton is illustrated in FIGS. 8 and 9. The prior art carton 20 has a floor 15, a pair of opposed sidewalls 16 and a pair of opposed endwalls 18. The endwalls 18 are comprised of a medial wall 21, an exterior endwall panel 22 and an interior endwall panel 24. The wall panels 22, 24 are formed from the same panel, and are separated by fold lines 26, 27. Slots or recesses 28, 30 formed in line with the fold line 26 receive upstanding locking posts 32, 34, respectively extending from one corner of medial wall 21.

As mentioned, the upstanding posts 32, 34 are received in recesses 28, 30 formed along the fold line joining outer and inner endwall panels 22, 24, respectively. When the cover panels 38, 44 are lowered in position, with panel 44 overlying panel 38, the interior of the carton 20 is closed. To maintain the cover panels in a closed position, locking tabs 42 are inserted through generally V-shaped slits 54 formed in endwall panel 22. An underlying cover panel 38 has marginal notches or recesses 40 formed therein for receiving locking tabs 42 extending from an overlying cover panel 44. When inserted in the slits 54, the locking tabs are trapped between the medial and outer endwall panels 21, 22, respectively, and the rear edge 50 of locking tabs 42 (see FIG. 7) engage the edges 56 of recesses 40 formed adjacent a marginal edge of the carton blank. If an excessive, abnormal load is placed on the carton top, as when a workman stands or jumps on top of the carton, the lower cover panel 38 could be permanently depressed, with edges 56 thereof coming out of engagement with the rearward edges 50 of locking tabs 42, and thus compromising the retention of the cover flaps in their closed position.

Referring again to FIG. 7, it can be seen that the locking posts closest to cover panel 44 protrude outwardly from a generally continuous, straight line edge 35. These corner posts are to some extent unprotected if exposed to rough handling or inadvertent impact. If the corner posts should become deformed prior to erection, it may be difficult to register the locking posts with recesses formed in the fold line between adjacent panels 22, 24. Further, if a large number of carton blanks are stacked one on top of the other on top of a pallet, a row of exposed locking posts will appear at the middle portion of the palletized load. Forklift trucks, tractors and other materials handling machinery used on or about the palletized loads could damage the projecting locking posts if they are backed into or are otherwise inadvertently contacted with a palletized load.

Attention will now be directed to cartons constructed according to principles of the present invention and, as will be seen herein, substantial improvements over the prior art have been made, without increasing the size of the carton blank, or contributing to an increased cost associated with manufacture of the carton blank. Further, cartons constructed according to the present invention can be quickly and easily fully erected without using adhesive, staples, or the like fasteners.

Referring now to FIGS. 1-6, and initially to FIGS. 1 and 2, carton 400, constructed according to the present invention, has a generally rectangular bottom wall 430 with a pair of opposed endwalls 406, 408 extending upwardly therefrom. A pair of opposed triple-thickness sidewalls extend from bottom wall 430 and cooperate with endwalls 406, 408 to form an open-top receptacle. An overlying lid 402 extends from endwall 406 and an underlying lid 404 extends from endwall 408. As shown in FIG. 1, the free end of lid 404 is disposed underneath the overlying lid 402. The lid members 402, 404 are hingedly secured to the endwalls so that they may be swung open in the manner indicated in FIG. 2 to allow access to the interior of the carton. The overlying lid 402 is connected to one edge of endwall 406 by a fold line 403. The underlying lid 404 is connected by fold line 405 opposite the fold line 409 of endwall 408.

As shown in FIG. 2, a pair of locking tabs 424, 426 extend from the free end of lid 402. As shown in FIGS. 1 and 3, and as will be explained in greater detail herein, the locking flaps are received in the hand holes 414, 416 of the carton sidewalls to provide a locking of the lid members 402, 404 to insure a secure seal against dust intrusion and to prevent their unintentional opening during shipment, for example.

Figure 6:
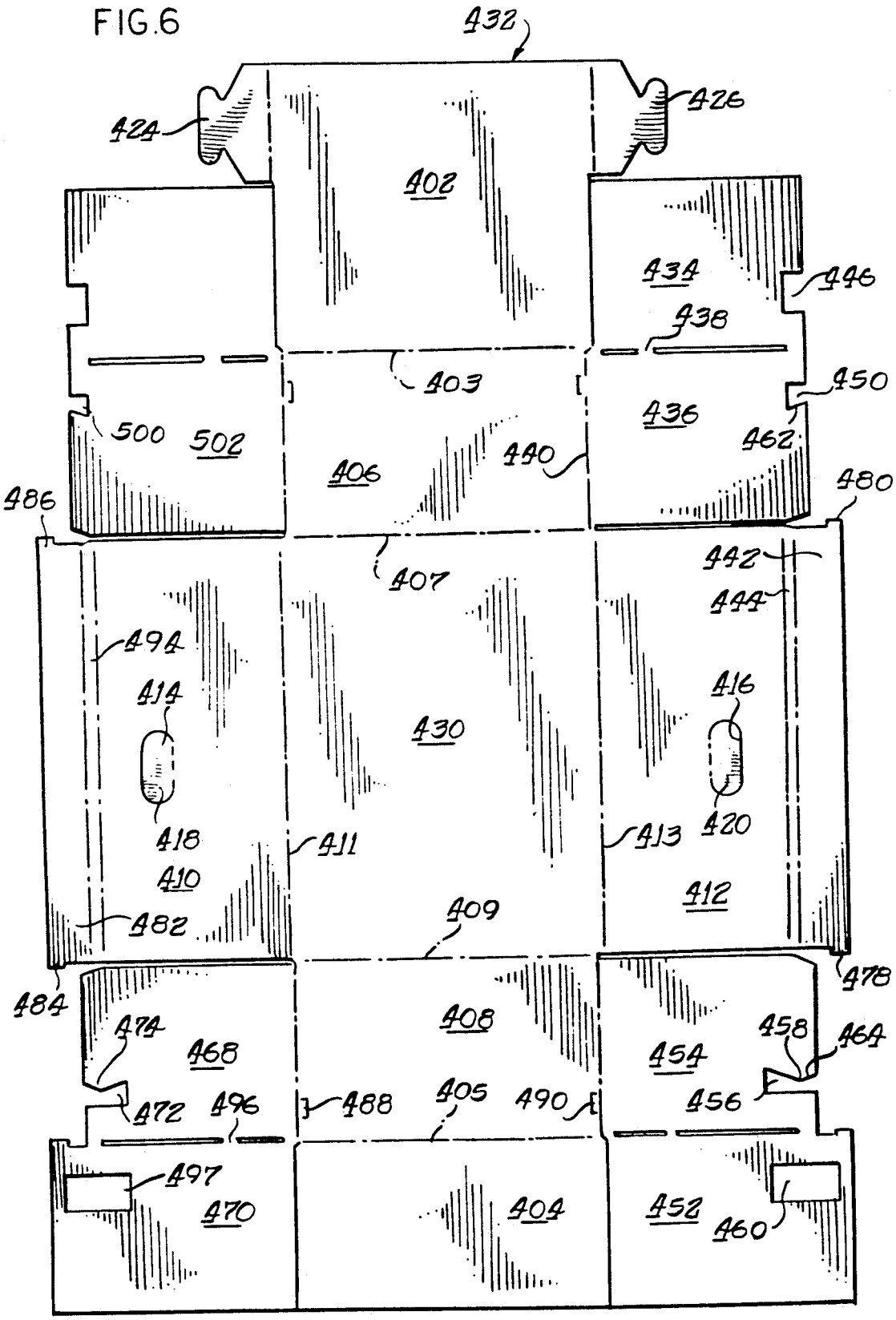
FIG. 6 is a plan view of a carton blank from which the carton of the preceding figures is constructed.

FIG. 6 shows a unitary carton blank 432 from which carton 400 is erected, without use of adhesive or fastener elements. The carton blank 432 is preferably made from a unitary sheet of paper board material such as corrugated cardboard, but can be made from any suitable material which allows folding of various panel portions of the carton blank along defined fold or hinge lines. The bottom wall 430 of the carton is centrally located in the carton blank 432, with the remainder of the various components and portions of carton 400 being hingedly connected to bottom wall 430 by fold lines shown in dot-dash legend. For example, endwall 406 is joined to one edge of bottom wall 430 by fold line 407, and endwall 408 is joined to an opposite edge of bottom wall 430 by a fold line 409. As will be seen herein, the sidewalls are each formed of three overlying layers to provide an increased load carrying capability. The outer sidewall layers 410, 412 are joined to opposing edges of bottom wall 430 by fold lines 411, 413.

As can be seen in FIG. 6, the carton blank 432 is symmetric about a major center line extending through the lid members 402, 404. The carton is however asymmetric with respect to a minor center line extending through the carton hand holes. The outer perimeter of carton blank 432 has a generally rectangular configuration which minimizes waste, and renders the blanks resistant to damage through inadvertent contact when the blanks are stacked one on top of another for bulk loading. The cartons according to the present invention have found ready commercial acceptance in the meat packing industry, where cartons are assembled at a pace set by the mass production lines of the carton user. Usually, large numbers of cartons are provided at a fabrication point along the assembly line, and it has been found convenient to ship large numbers of carton blanks on a pallet carrier. As those familiar with shipping practices are aware, palletized loads are subjected to inadvertent contact, as when a forklift operator backs his forklift against a palletized load, or uses one palletized load to push another. As will be seen herein, it is important that the outside corners of the medial sidewalls be protected against deformation, and the carton blanks according to the present invention provide this advantage in an economical manner. As will be seen herein, the corners of the carton blank are not placed in critical locations when the carton is assembled.

The carton 400 has a pair of lid flaps 402, 404 attached to endwalls 406, 408, and which are dimensioned to overlap one over the other, when closed, as illustrated in FIG. 1. The sidewalls 410, 412 have hand holes 414, 416 which are incompletely formed, to produce oval tabs 418, 420 which are hinged at their bottom ends to form a self-locking with the locking ears 424, 426 carried at the free end of lid 402.

As mentioned, pairs of folded reinforcing panels are located at each corner of carton 400 and extend to the floor 430 thereof to provide increased stacking strength. Referring to the carton blank 432 illustrated in FIG. 6, a pair of reinforcing panels is located between lid 402 and sidewall 412. The reinforcing panels 434, 436 are joined together along a fold line 438. Panel 436 is hinged to endwall 406 by a fold line 440.

A reinforcing beam 442 is joined by a hinge wall 444 to carton sidewall 412. The reinforcing panel 434 has a rectangular notch 446 formed at the outer edge thereof, and is located so as to overlie hand hole opening 416. When the carton is fabricated, reinforcing panel 434 bears against sidewall 412 and reinforcing panel 436 faces the carton interior, as can be seen in FIG. 2. Reinforcing panel 436 has a keystone-shaped slot 450 which overlies the hand hole 416, at one end thereof. Preferably, the carton lids 402, 404 are of dissimilar proportions, carton lid 402 being larger. Thus, carton 400 is asymmetric and other features contribute further to the asymmetry. For example, the reinforcing panels 452, 454 which are associated with the aforedescribed reinforcing panels 434, 436, have dissimilar features. For example, the reinforcing panel 454 has a four-sided slot 456 including a generally V-shaped crown portion 458. Reinforcing panel 452 includes a rectangular cut-out 460 which is aligned in registry with the rectangular notch 446 of reinforcing panel 434. The notches 450, 456 of reinforcing panels 436, 454 are also aligned in registry with edge 462 of slot 450, aligned with edge 464 of slot 456.

Preferably, the carton blank 432 is symmetric about a longitudinal center line and accordingly, sidewalls 410, 412 are mirror images of one another. Also, reinforcing panels 468, 470 are mirror images of reinforcing panels 454, 452. For example, reinforcing panel 468 has a four-sided slot 472 forming a V-shaped crown edge 474.

As can be seen in FIG. 2, and in FIG. 6, reinforcing beam 442 has outwardly extending locking projections 478, 480, comprising mirror images of the reinforcing beam 482 with locking projections 484, 486. As can be seen in FIG. 1, for example, endwall 408 has notches 488, 490 for receiving the locking projections 484, 478, respectively.

Referring now to FIG. 3, locking arrangement of carton 400 will be described. When the carton is fully formed, reinforcing panel 470 presses against sidewall 410, while reinforcing panel 468 faces the carton interior. A hinge wall 444 overlays the fold line 496 joining reinforcing panels 468, 470. Reinforcing beam 482 is folded to face the carton interior, pressing against reinforcing panel 468. The rectangular slot 497 in panel 470 overlies hand hole 414 and is aligned in registry with the cutouts 472 of panel 468 and a smaller cut-out 500 of reinforcing panel 502 (see FIG. 6). Thus, locking ear 424 carried on lid 402 is free to enter hand hole 414 with deflection of oval tab 418 inwardly, as illustrated in FIG. 3. Thus, dust is prevented from entering through the hand hole, and the locking tabs are wedged in a fixed position, as illustrated in FIG. 3. It is important to note that locking ear 424 is locked in place at an upward inclination, being wedged against the reinforcing beam, and the reinforcing panels by oval tab 418 which is pressed in an outward direction by crown portion 474, thus providing a positive locking engagement.

Figure 10:
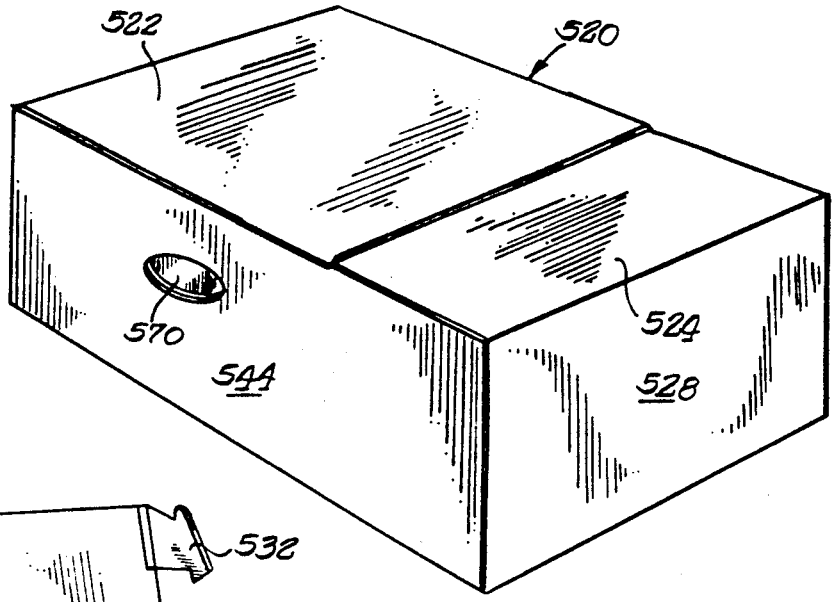
FIG. 10 is a perspective view of another carton constructed according to principles of the present invention.
Figure 11:
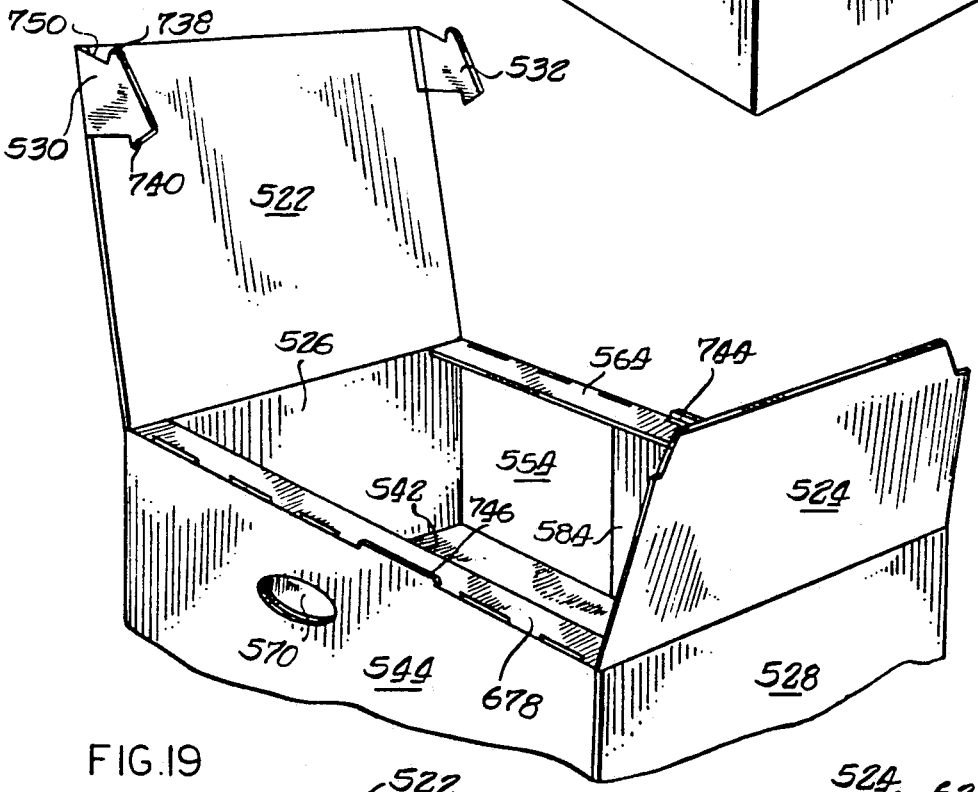
FIG. 11 shows the carton of FIG. 10 in an open position, with the carton lids folded back.

Turning now to FIG. 10, a further embodiment of a carton constructed according to principles of the present invention is shown generally at 520. As with the other embodiments, carton 520 is of a tri-sidewall design with a complete cover closure, so as to be suitable for use in the meat packing industry, and for other applications where heavy products must be protected from outside contamination. Carton 520 has overlapping lids 522, 524 which are hinged from opposed endwalls 526, 528, respectively. As can be seen in FIG. 11, lid 522 has a pair of downwardly depending locking tabs 530, 532.

Figure 12:
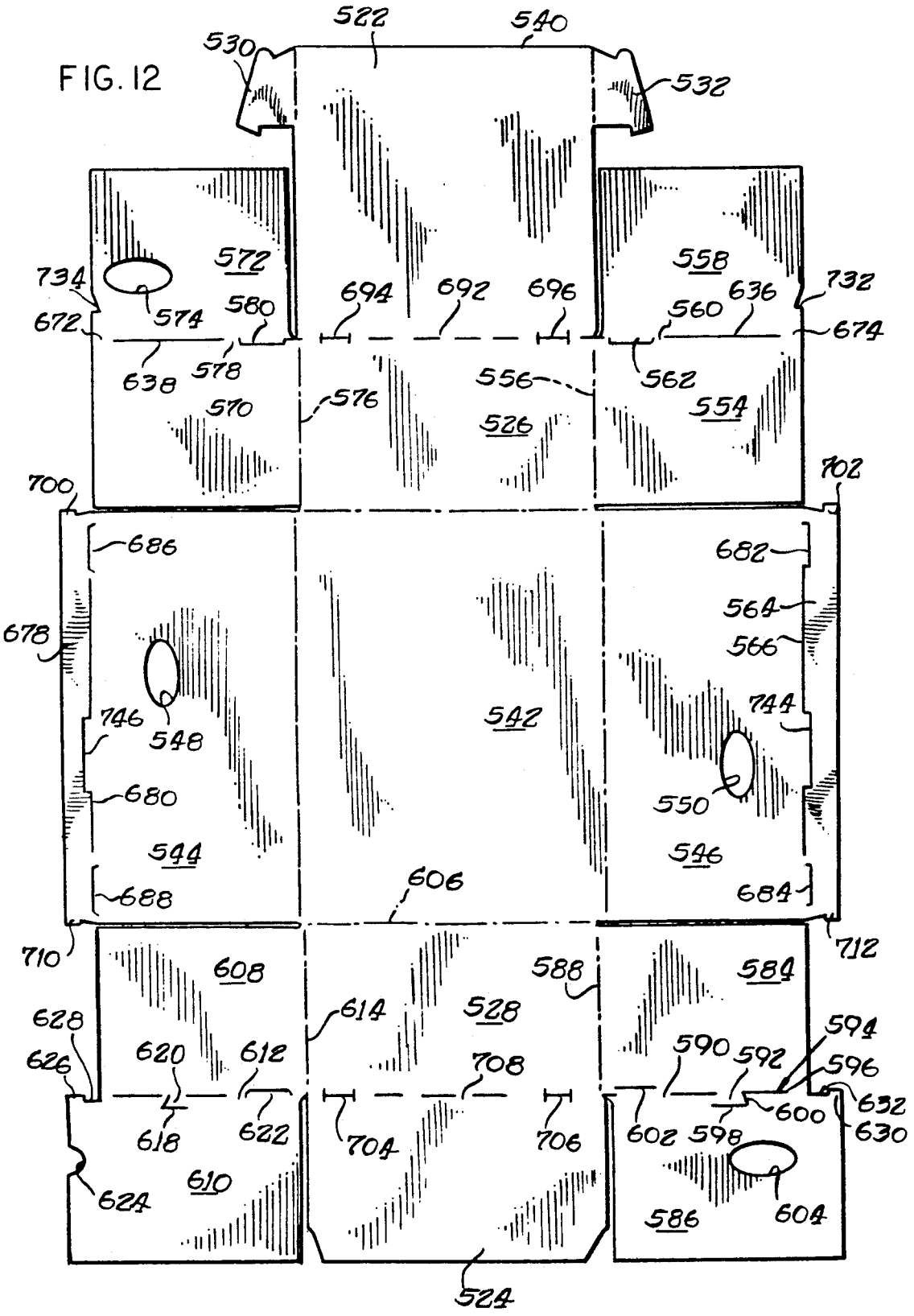
FIG. 12 is a plan view of a paper board blank from which the carton of FIGS. 10 and 11 is constructed.
Figure 13:
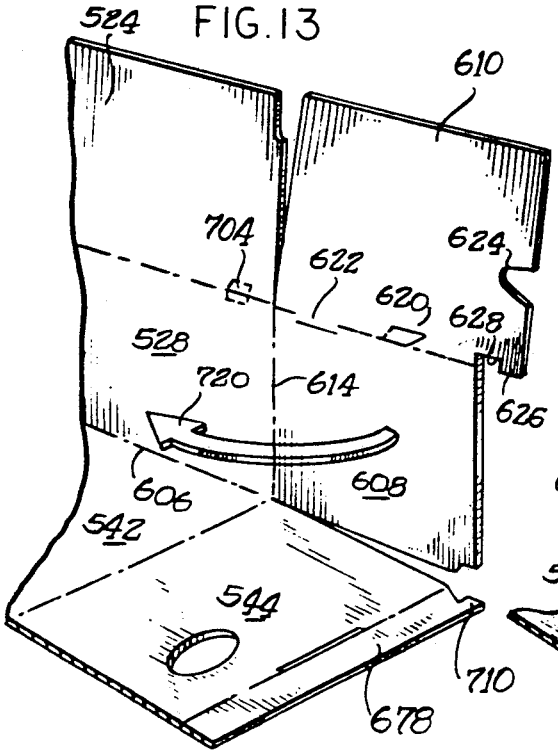
FIGS. 13-16 are fragmentary perspective views showing a sequence of assembly of the carton.
Figure 14:
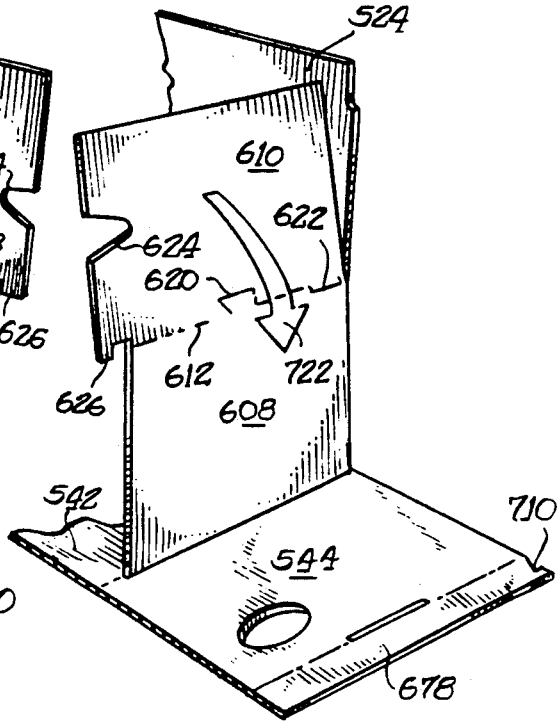

Attention will now be directed to FIG. 12 showing the carton blank 540 from which the carton 520 is formed, and FIGS. 13-20 which illustrate assembly of the carton blank. The carton blank 534 includes a floor panel 542 foldably joined to outside sidewall panels 544, 546 in which oval-shaped hand hole cutouts 548, 550, respectively are formed. As can be seen in FIGS. 10 and 11, the sidewall panel 544 which extends between the endwalls 526, 528, is located on the outside of the carton. Pairs of interior sidewalls or reinforcing panels are located at each corner of blank 540. For example, reinforcing panel 554 is connected by fold line 556 to end panel 526. Reinforcing panel 558 is connected by fold line 560 to reinforcing panel 554. Fold line 560 is interrupted at its inner end by the formation of a locking post 562 which extends from panel 558, and is used to lock the reinforcing beam 564 which is joined to sidewall panel 546 by fold line 566.

The blank 540 is asymmetric with respect to its longitudinal center line passing through lid portions 522, 524 and also with respect to its minor center line passing through sidewall panels 544, 546 and floor panel 542. For example, a reinforcing panel 572 at the laterally opposite side of the carton blank has an oval hand hole cut-out 574 whereas panel 558 has no cut-out. Reinforcing panel 570 is hingedly joined to end panel 526 by fold line 576 and panel 572 is joined to panel 570 by fold line 578. A locking post 580 interrupts fold line 578, the locking post extending from panel 572 so as to be upstanding above fold line 578, but the flaps 570, 572 are folded together.

Referring to the bottom of FIG. 12, reinforcing panels 584, 586 depend from end panel 528 being connected by fold lines 588, 590. According to one aspect of the present invention, fold line 590 is discontinuous, being interrupted by locking tab 592, formed by a generally Z-shaped cut 594 comprised of a first portion 596 extending along fold line 590, an opposite end portion 598 extending generally parallel to but spaced from fold line 590, and an intermediate bias cut 600. The cut lines 598, 600 form a free corner of locking tab 592 which "pops out" of the plane of reinforcing panel 586, when panels 584, 586 are folded together, by reason of cut line 596. A locking post 602 also interrupts fold line 590, so as to protrude from panel 586, upstanding above the fold line when panels 584, 586 are folded together. Panel 586 has an oval hand hole cut-out 604 formed therein so as to be aligned in registry with hand hole cut-out 550 when the carton is erected. According to another aspect of the present invention, the hand holes 604, 550 are aligned in registry, but do not form an opening extending to the interior of carton 520. When the carton is erected by folding end panel 528 to an upright position by bending at hinge line 606, panel 586 is folded to face the outside of the carton, leaving solid panel 584 to face the carton interior. Thus, panel 584 blocks the hand hole passageway formed by the registration of hand hold cutouts 550, 604.

The the laterally opposite corner of carton blank, reinforcing panel 610 is hingedly connected at 612 to reinforcing panel 608, which in turn, is hingedly connected at 614 to end panel 528. The hinge line 612 is a mirror image of the hinge line 590 described above. A Z-shaped cut 618 forms a locking projection 620. A locking post 622 extends from panel 610. Panel 610 has a part oval recess 624 formed at an outside edge thereof. Located at a corner of panel 610, above recess 624 is a locking post 626 disposed immediately adjacent a recess 628 which is indented with respect to fold line 612. A similar construction is present in panel 586 where locking post 630 is disposed immediately adjacent an indentation or recess 632. The locking post 630 is received in a slot 636 formed between panels 558, 554, extending along fold line 560. Locking post 626 is received in a slot 638 extending along fold line 578, between panels 570, 572. Thus, the locking posts 626, 630 form an interlocking joinder adjacent the centers of sidewalls 544, 546, locking the reinforcing panels together, on each side of carton 520.

Strap portions 672, 674 join panels 570, 572 and 554, 558 together, at their marginal edges. The strap portions are received in indentations 628, 632, respectively to provide further interlocking of the reinforcing panels associated with a given carton sidewall.

The reinforcing beam 564 connected to sidewall 546 and a reinforcing beam 678 joined at fold line 680 to sidewall 544 include recesses for receiving the locking posts of reinforcing panels located at outside corners of carton blank 540. For example, reinforcing beam 564 includes slots 682, 684 which receive locking posts 562, 602, respectively. In a similar manner, reinforcing beam 678 includes slots 686, 688 which receive locking posts 580, 622, respectively. The ends of reinforcing beams 564, 678 include locking ears received in slots formed along the fold lines joining lid portions to end panels 526, 528. For example, lid 522 is joined at fold line 692 to endwall 526. Slots 694, 696 receive locking ears 700, 702 of reinforcing beams 678, 564, respectively. In a similar manner, slots 704, 706 extend along fold line 708 joining lid 524 to endwall 528. These slots receive locking ears 710, 712 formed at the adjacent ends of bridge members 564, 678, respectively.

Figure 15:
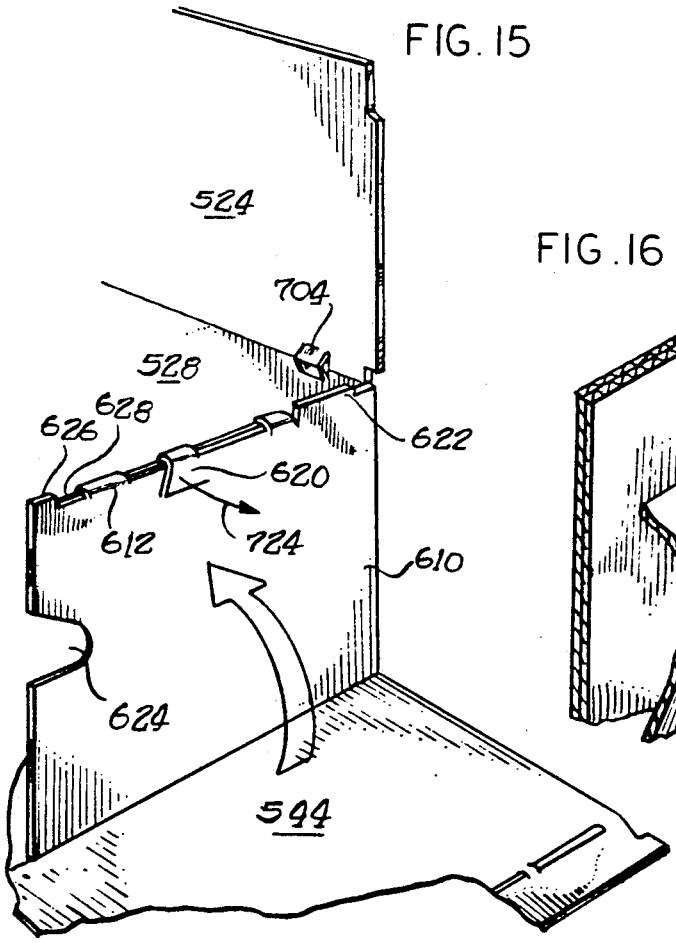

Referring now to FIGS. 13-18, and initially to FIGS. 13-16, erection of the carton will be described. Initially, the end panels of the carton are raised to an upright position. For example, in FIG. 13, endwall 528 is raised to an upright position, being bent along fold line 606. Next, the reinforcing panels 608, 610 are swung in the direction of arrow 720 to assume the position illustrated in FIG. 14. The upper reinforcing panel 610, that panel carrying the part oval recess 624 is then swung in the downward direction of arrow 722, away from the carton interior, so as to face sidewall 544, as shown in FIG. 15. As reinforcing wall 610 is folded about fold line 612, the two-sided retention tab 620 pops out of the plane of reinforcing panel 610, in the direction of arrow 724.

Figure 16:
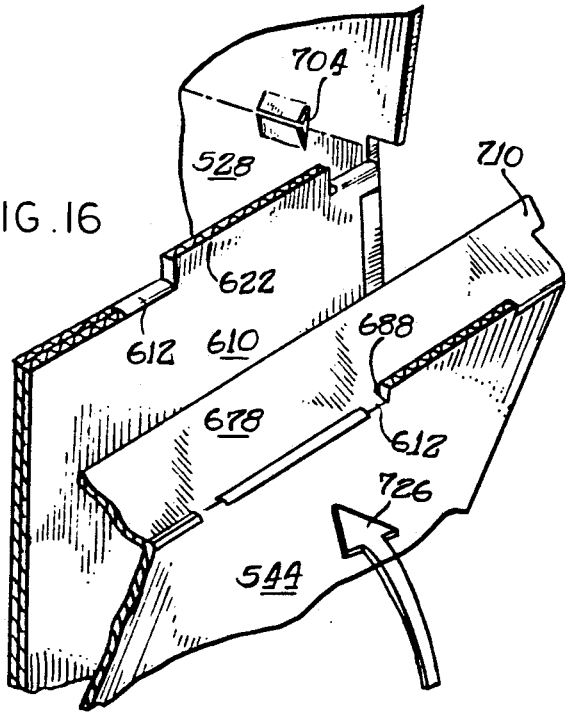
Figure 18:
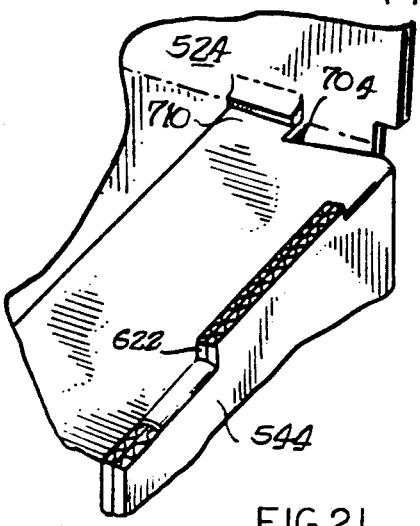
FIG. 18 is a fragmentary perspective view showing the assembly step indicated in FIG. 17 in greater detail.
Figure 17:
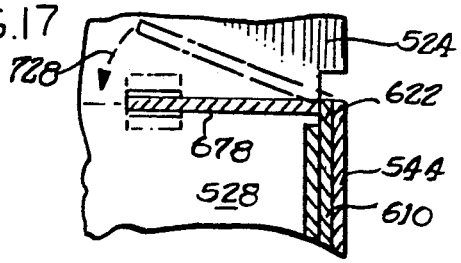
FIG. 17 is a fragmentary, cross-sectional view showing continued assembly of the carton.

Referring to FIG. 16, the sidewall 544 is then swung in the upright position, in the direction of arrow 726, so as to mate against reinforcing wall 610 and 572. Thereafter, reinforcing bridge 678 is folded at a right angle to sidewall 544, thus causing insertion of locking post 622 in slot 688. The reinforcing bridge 678 is lowered in the direction of arrow 728, as illustrated in FIG. 17. The reinforcing bridge 678 is locked in place as retention ear 710 is received in slot 704, as illustrated in FIG. 18.

Figure 19:
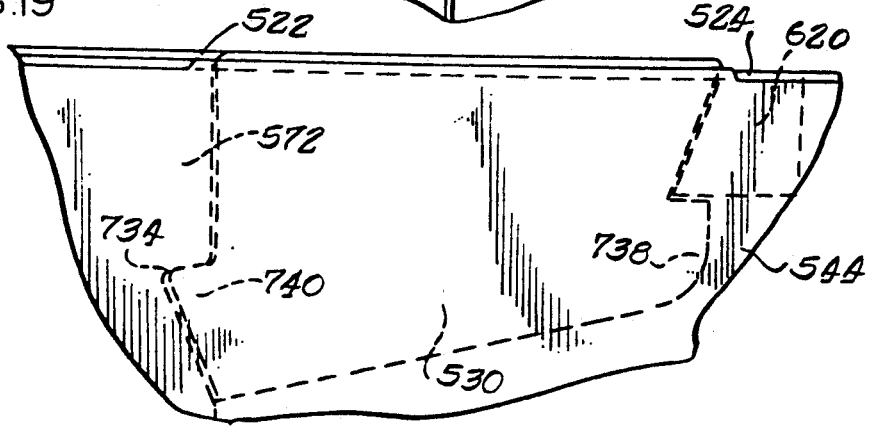
FIG. 19 is a fragmentary side elevational view showing locking of the carton lid members.
Figure 20:
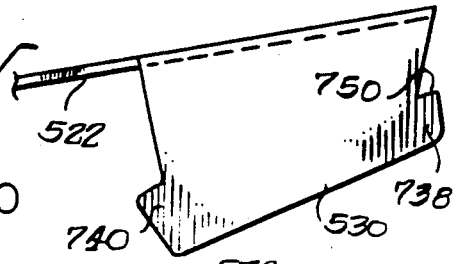
FIGS. 20 and 21 are fragmentary elevational views showing steps for locking the carton lid members.
Figure 21:
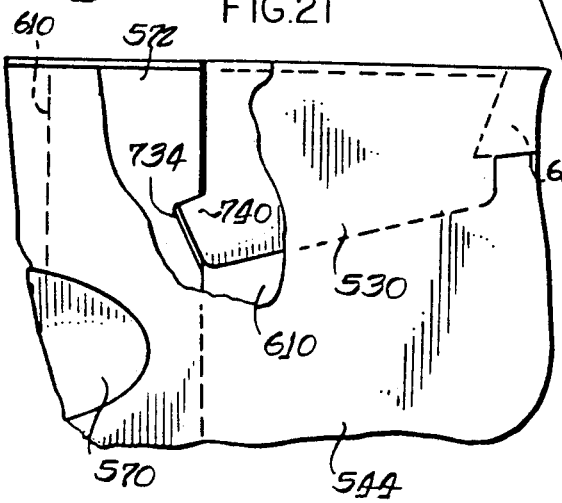
Figure 21:
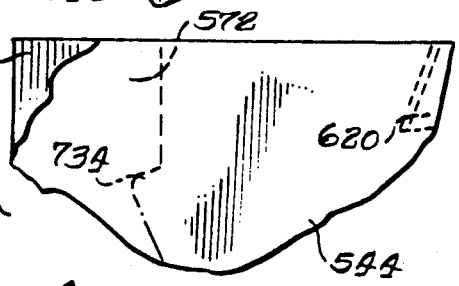

Before proceeding with a description of the improved cover locking, attention is directed to FIG. 12 and reinforcing panels 558, 572 at the upper end of the figure. Reinforcing panel 558 has a V-shaped notch 732 formed at an outside edge thereof, adjacent strap 674. Reinforcing panel 572 has a V-shaped notch 734 formed therein, adjacent strap 672. As indicated in FIGS. 19-21, the notches interact with locking tabs 530, 532 to lock one end of the tabs. Turning now to FIG. 20, locking flap 530 has opposed locking ears 738, 740. As indicated FIG. 20, reinforcing panel 572 overlies panel 610 so that the edge thereof in which recess 734 is formed, protrudes beyond the plane of reinforcing panel 610. Slits 744, 746 formed along fold lines 566, 680 provide openings for receiving locking ears 532, 530, respectively. For example, with reference to FIG. 20, slot 746 extends into reinforcing bridge 678 to provide an opening for receiving locking ear 530, the locking ear being pressed between sidewall 544 and reinforcing panel 610. As mentioned, reinforcing panel 572 lies on top of panel 610 exposing the edge carrying V-shaped notched 734. As illustrated in FIG. 21, the locking ear 740 of tab 530 is received in notch 734. At the other end of locking tab 530, the locking projection 620 is received in the recess 750 formed adjacent locking ear 738. Thus, tab 530 is secured at its ends by engagement with the edge of reinforcing panel 572 and the locking projection 620 extending from panel 610. As mentioned, the locking tab 530 is trapped between sidewall 544 and reinforcing panel 610, and thus locking engagement with tab 530 is maintained.

Figure 22:
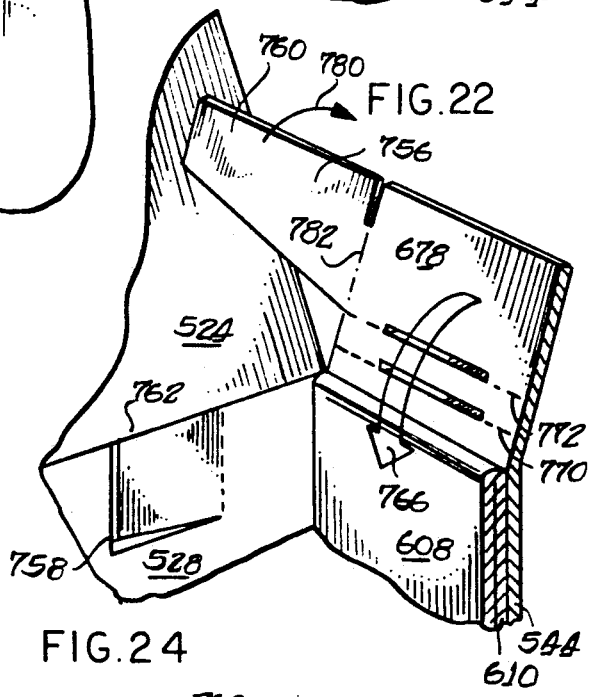
FIGS. 22-24 are fragmentary views of a carton constructed according to principles of the present invention, having an alternative locking arrangement for a reinforcing beam extending along the carton sidewalls.
Figure 23:
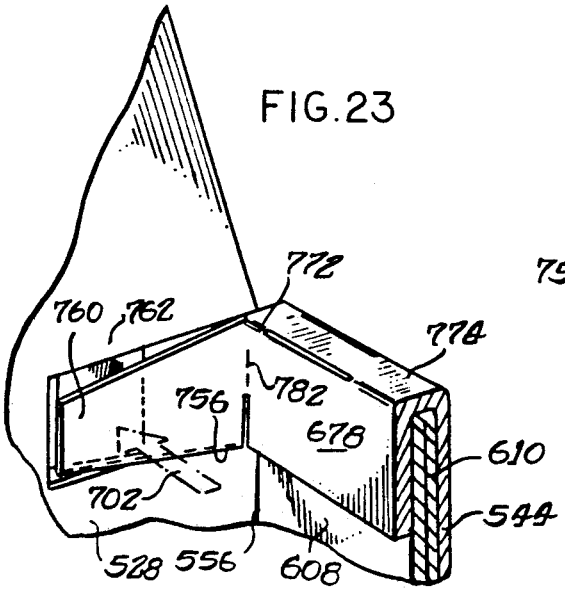
Figure 24:
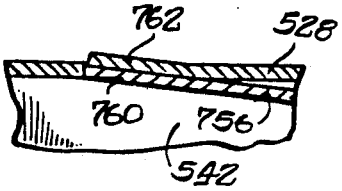

Turning now to FIGS. 22-24, an alternative arrangement for locking the reinforcing bridge to the carton endwalls is shown. In the embodiment shown in FIGS. 22-24, a retaining ear 756 extends from each end of reinforcing bridge 678. In place of the slot 704 described above, a three-sided recess 758 is formed in endwall 528 to receive the tip 760 of retaining ear 756. In forming recess 758, a hinged tab 762 is formed in end panel 528, the tab being swung out when the reinforcing bridge is swung into position against reinforcing panel 608, in the direction of arrow 766, as shown in FIG. 22. Further differences are shown in FIGS. 22-24. For example, reinforcing bridge 678 is bent inside the carton interior, against reinforcing panel 608, rather than extending parallel to the lid portions. In place of the single hinge line 566 joining the reinforcing bridge to sidewall panel 546, a pair of spaced parallel fold lines 770, 772 form an intermediate wall 774, which extends parallel to and contacts lid 522 when the carton is assembled to the closed position illustrated in FIG. 10. As can be seen in FIG. 22, for example, recess 758 is spaced from the carton sidewall and is not located adjacent fold line 556 joining the endwall to the reinforcing sidewall 608. As indicated in FIG. 22, retention ear 756 is folded back in the direction of arrow 780 being flexed along hinge line 782 joining the retaining ear 756 to the reinforcing bridge 678. This provides sufficient pressure on retaining ear 756 to force tab 762 in the outward direction indicated by arrow 782 of FIG. 23.

Figure 25:
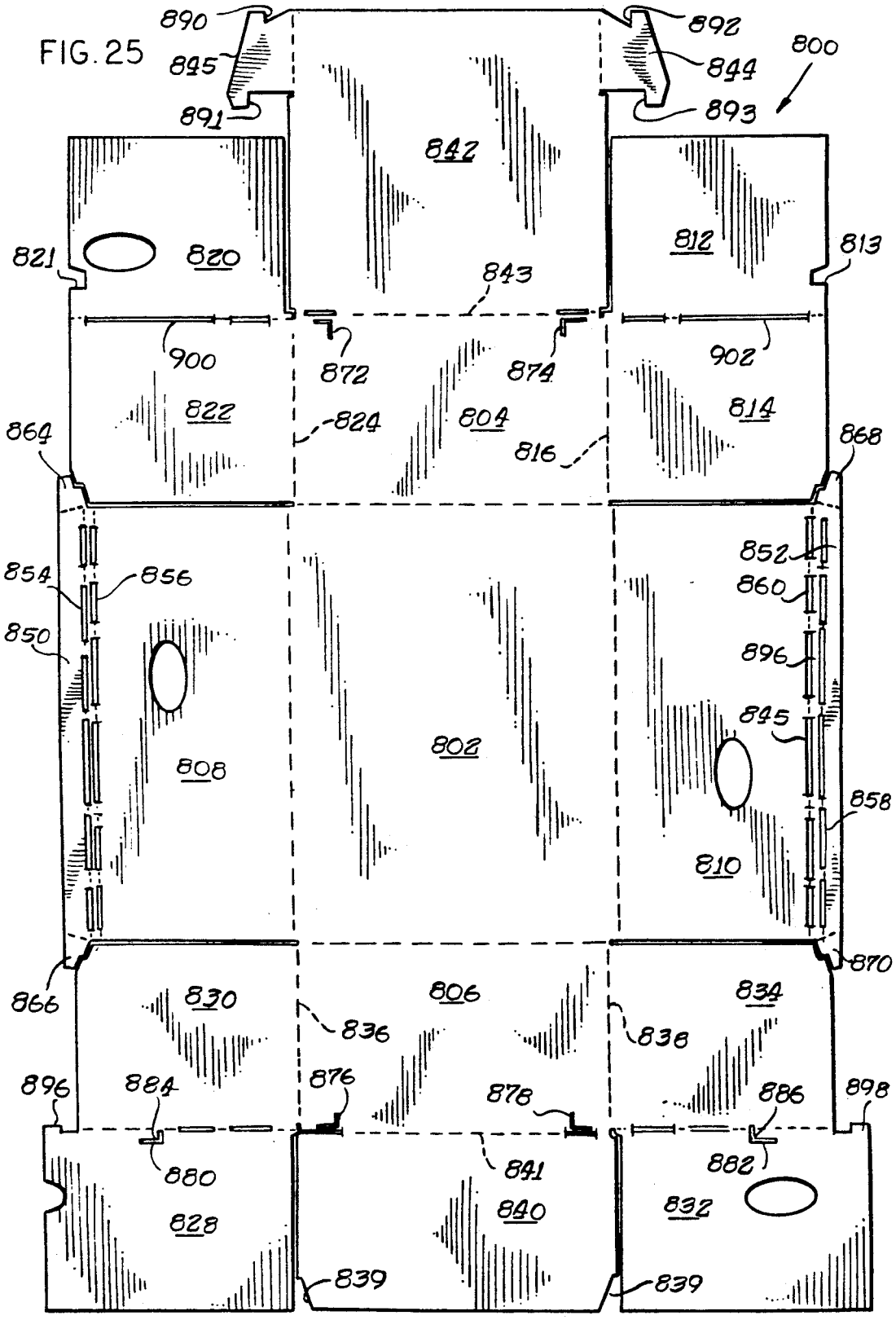
FIG. 25 is a plan view of a carton blank according to principles of the present invention from which an alternative carton is constructed.

Turning now to FIG. 25, a further embodiment of a carton blank constructed according to principles of the present invention is shown. Carton blank 800 generally resembles the carton blank 540 of FIG. 12, but includes differences in the locking of the reinforcing beam and the locking ears of the lid member, for example. Carton blank 800 includes a floor 802, opposed endwalls 804, 806 and a pair of opposed outer sidewalls 808, 810 joined to the marginal edges of the floor by respective fold lines. Referring to the top right-hand corner of FIG. 25, a pair of intermediate sidewalls 812, 814 are hingedly joined together, and sidewall 814 is hinged to endwall 804 by hinge line 816 Intermediate sidewalls 820, 822 are hingedly connected by a discontinuous hinge and sidewall 822 is joined to endwall 804 by hinge line 824. At the bottom end of FIG. 25, intermediate sidewalls 828, 830 are connected together by a discontinuous hinge line and intermediate sidewalls 832, 834 are also connected together by a discontinuous hinge line. Intermediate sidewalls 830, 834 are joined to opposing ends of endwall 806 by respective joint lines 836, 838. An underlying lid member 840 is hingedly connected to endwall 806 and an overlying lid member 842 is hingedly connected to the opposing endwall 804. Lid member 842 carries a pair of locking ears 843, 844 at its free end. The outer sidewalls 808, 810 and the intermediate sidewalls 820, 832 each have full hand holes formed therein.

Reinforcing beams 850, 852 are joined to outside sidewalls 808, 810, respectively. A pair of parallel, discontinuous fold lines 854, 856 are located between reinforcing beam 850 and sidewall 808. Similarly, a pair of parallel, spaced apart, generally discontinuous fold lines 858, 860 are located between reinforcing beam 852 and sidewall 810. Reinforcing beam 850 is hingedly joined at its ends to stepped end portions 864, 866. Stepped end portions 868, 870 are joined to the ends of reinforcing beam 852 by respective fold lines.

One feature not present in the preceding blanks, are the L-shaped cut portions 872, 874 formed in endwall 804 and the L-shaped cut portions 876, 878 formed in endwall 806. These cut portions form recesses for receiving the stepped locking ears hingedly connected to the end portions of reinforcing beams 850, 852.

As another important feature distinguishing blank 800, L-shaped cutout portions 880, 882 are formed in intermediate sidewalls 828, 832. The L-shaped cut portions 880, 882 form generally right angled, free corner portions 884, 886 which engage the stepped edge portions 890, 892 of locking ears 843, 844, respectively.

It should be noted that the L-shaped cut portions 872-878 have legs formed adjacent to, but spaced from the fold lines 841, 843 joining the respective lid portions to adjacent endwalls. As shown in FIG. 25, the fold lines 841, 843 are broken by cut segments located immediately adjacent the L-shaped cut portions. As will be seen herein, these features maintain engagement of the stepped ears 864-870 with the L-shaped cut portions, even when the lid portions are swung to an open position.

A pair of locking posts 896, 898 are located on intermediate sidewalls 828, 832, respectively. As will be seen herein, these locking posts are received in the slotted portions 900, 902 formed in the fold lines joining intermediate sidewalls 820, 822 and 812, 814, respectively.

Figure 26:
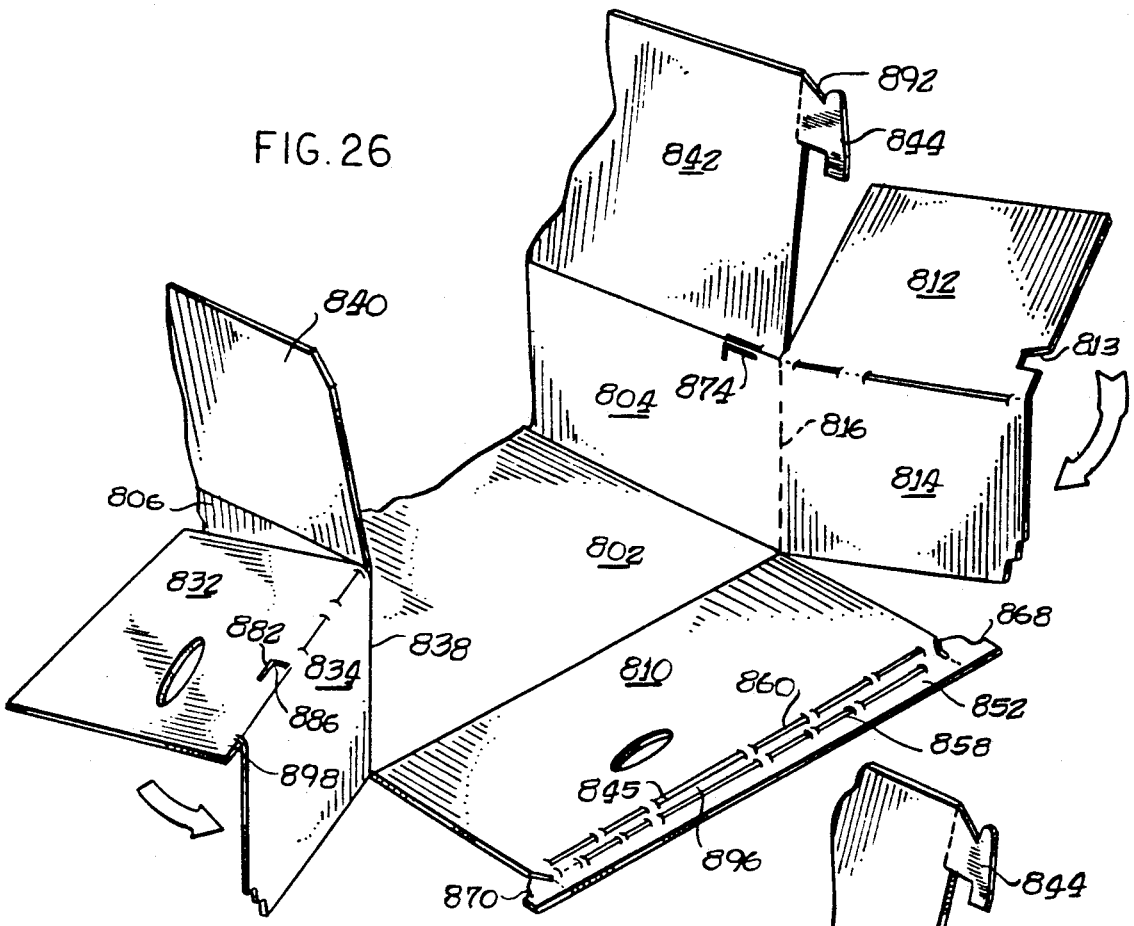
FIGS. 26-29 are fragmentary perspective views showing the assembly steps of the carton sidewalls.
Figure 29:
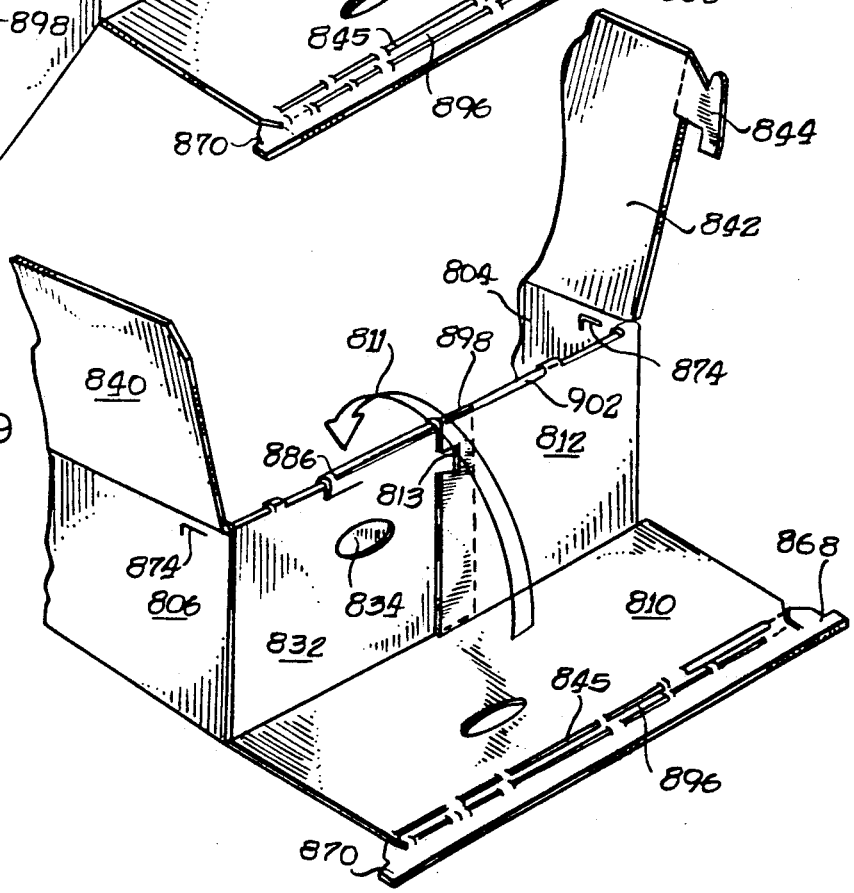

Referring now to FIGS. 26-35, construction of the carton will now be described. As illustrated in FIG. 26, endwalls 804, 806 are folded to an upright position, forming generally right angles with the floor panel 802. Next, the intermediate sidewalls are swung to the closed position illustrated in FIG. 29. The intermediate sidewall 834 is swung about its hinge line 838 and intermediate side panel 832 is folded against the hinged side panel 834. This position is illustrated in the left-hand portion of FIG. 27. Next, the intermediate side panel 814 is swung to the closed position generally coplanar with intermediate side panel 834. In the preferred embodiment, intermediate side panel 812 is then swung about the hinge line connecting it to side panel 814, thereby opening the slotted portion 902. Alternatively, the side panels 812, 814 can be folded against one another with endwall 804 at a slightly opened position forming an oblique angle with floor panel 802. With raising of end panel 804, the slotted portion 902 is effectively lowered onto locking post 898. In either event, the intermediate side panels are partially overlapped and are interlocked with one another in the manner illustrated in FIG. 28. FIG. 29 also shows the intermediate side panels in their interlocked condition.

Figure 30:
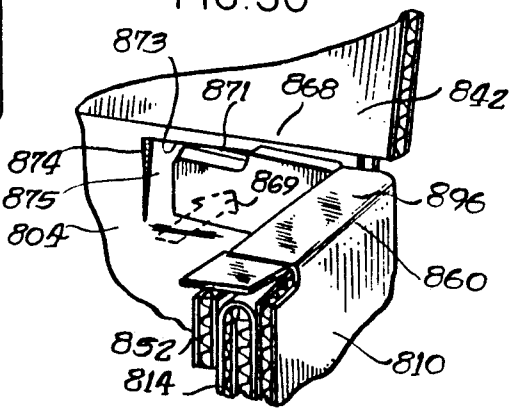
FIG. 30 is a fragmentary perspective view showing locking of a reinforcing beam extending along the carton sidewalls.
Figure 27:
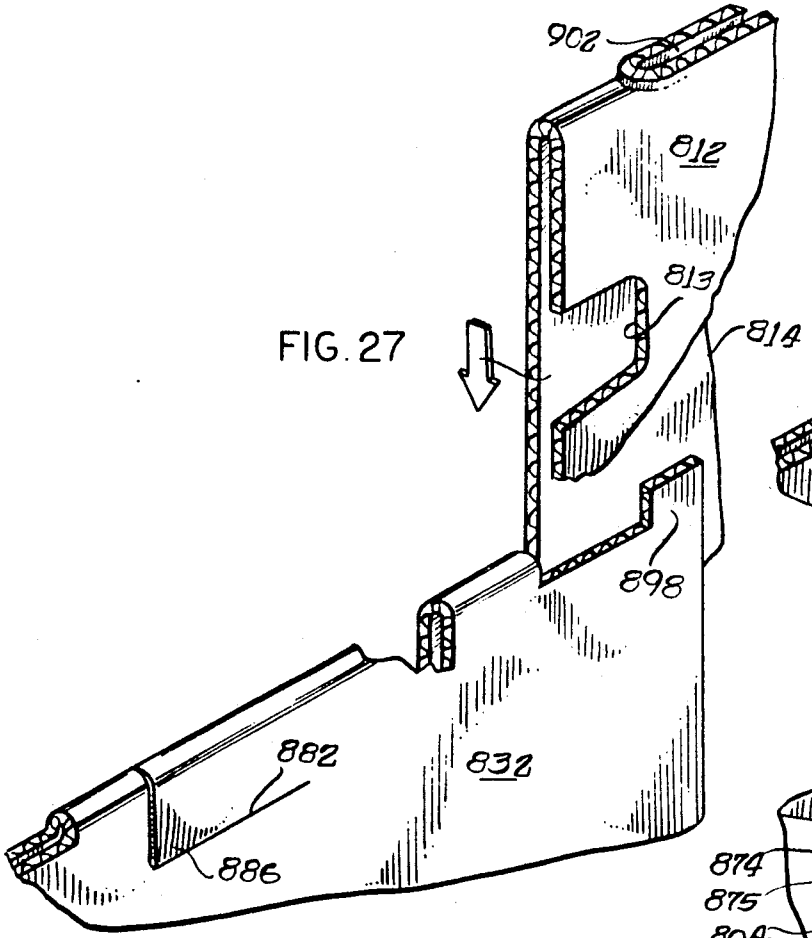

Next, the outside sidewall 810 is raised in the direction of arrow 811, bringing the sidewall 810 into contact with sidewall 812, 832. Referring now to FIG. 30, the reinforcing beam 852 is folded over against sidewalls 814, and 834, not shown in FIG. 30, located at the other end of the carton. To the spring back of the paper board material, the reinforcing beam 852 tends to open, bending away from the sidewalls panels, and accordingly must be locked in position. As shown in FIG. 30, the L-shaped cut portion 874 forms a push-out tab 875 which is deflected out of the plane of endwall 804 by locking ear 868 when pushed thereagainst in the direction of arrow 869. The stepped edge 871 of locking ear 868 engages endwall 804 preventing upward movement of the locking ear which would release reinforcing beam 852 to open up, swinging outwardly.

Turning now to FIGS. 31-35, locking of the carton lids will now be described. As will be noted in FIG. 25, the lid members 840, 842 are of unequal length, and are dimensioned to overlap one another when in a closed position. In the preferred embodiment, the lid 840 is closed first, and underlies the other lid member 842 which carries the locking ears 843, 844 which keep the lid members from springing open, once the carton is closed. Each locking ear carries a pair of stepped locking edges which extend away from one another, lying on either side of the major body portion of the locking ear. For example, locking ear 844 has a stepped edge 892 adjacent the marginal edge of the carton blank, and a generally trapezoidal-shaped stepped edge 893. The stepped edges 892, 893 are preferably generally parallel to one another so as to extend in a generally horizontal direction when the carton is closed, as will be seen herein. The stepped edges 892, 893 protrude outwardly from a central body portion of the locking ear. The stepped edge 892, for example, is formed by an acute angle cut extending from one marginal edge of overlying lid 842. The other stepped edge 893 is preferably formed by a generally right angle cut extending from the same marginal edge (see FIG. 52). The other locking ear 843 is a mirror image of locking ear 844 and includes stepped edges 890, 891.

Figure 28:
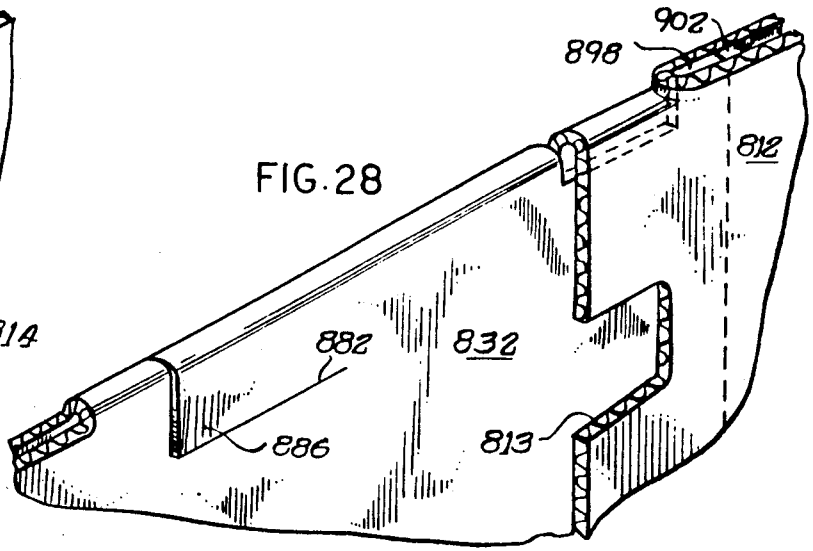

Referring again to the carton blank of FIG. 25, the intermediate sidewalls 812, 820 of carton blank 800 each have an outwardly opening locking recess. Sidewall panel 820 has a locking recess 821 formed adjacent the hand hole cutout, and sidewall panel 812 has a locking recess 813. The locking recess 813 is shown in greater detail in FIGS. 27 and 28 and as can be seen therein, the locking edge opens toward the mating sidewall panel, herein the sidewall panel 832. As seen in FIG. 28, the locking recess 813 is located approximate to the interlocking of post 898 and recess 902, an arrangement which minimizes shifting of the interlocking and inner-engaging carton components when the lids are in a closed and locked position.

Figure 31:
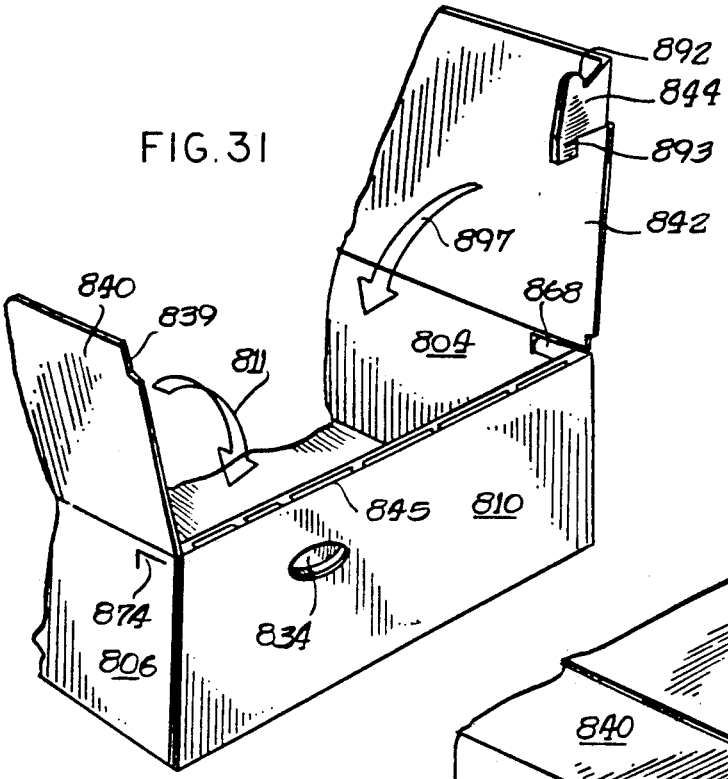
FIG. 31 is a fragmentary perspective view showing closure of the carton lid members.
Figure 35:
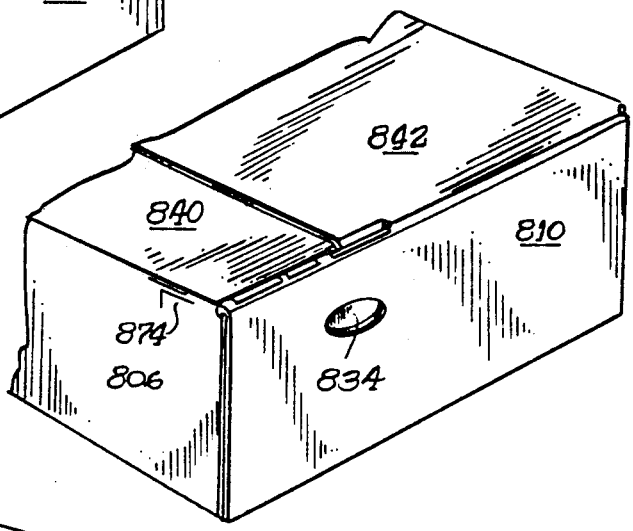
FIG. 35 is a perspective view of the fully assembled carton.

Referring again to FIG. 31, the underlying lid 840 is swung in the direction of arrow 811, into contact with the carton sidewalls. As can be seen in FIG. 31, underlying lid 840 has a cutaway portion 839 at its free corner which, as will be seen, allows passage of locking ear 844 past the underlying lid.

As was explained above with reference to FIG. 30, the reinforcing beam 852 is folded inside of the carton, into contact with the intermediate sidewall panel 814. The reinforcing beam 852 is joined to the outer sidewall panel 810 by a pair of spaced generally parallel, discontinuous fold lines 858, 860. These fold lines form a strip portion 896 therebetween which accommodates the folded-over double thickness portion of the intermediate sidewalls 812, 814, reinforcing the upper edges thereof.

A slot 845 is formed adjacent strip portion 896 to allow passage of locking ear 844 therethrough, allowing the locking ear to pass between the outer sidewall 810 and the intermediate sidewall panel 832. As illustrated in the figures, slot 845 is formed along the discontinuous fold line 860, but it may be desirable in some circumstances that the slot 845 extends fully between the fold lines 858, 860, in effect removing a section of strip portion 896.

Figure 32:
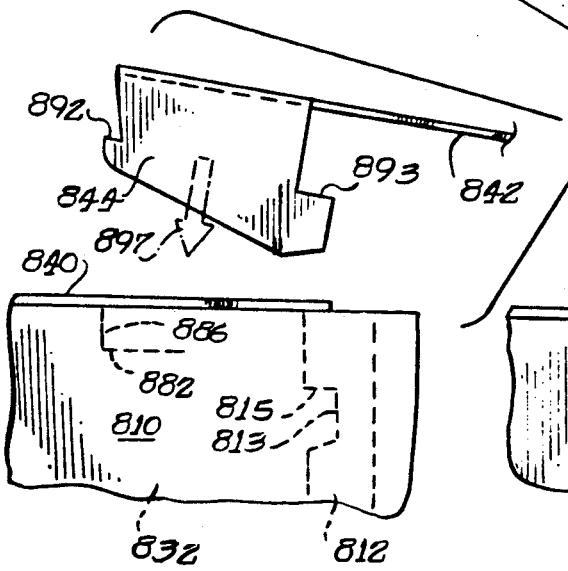
FIGS. 32 and 33 are fragmentary elevational views showing locking of the lid members.

Closing of the carton is completed by swinging lid member 842 downwardly in the direction of arrow 897 as illustrated in FIGS. 31 and 32. As lid 842 is lowered, locking ear 844 passes through slot 845, the locking ears thereafter being guided by side panels 810, 832. With continued insertion of the locking ear, the locking edges 892, 893 come into contact with locking tab 886 and locking recess 813, respectively. Locking tab 886 extends toward the free edge of lid 842, partially overlying the major body portion of locking ear 844, rather than opposing the locking ear.

Figure 34:
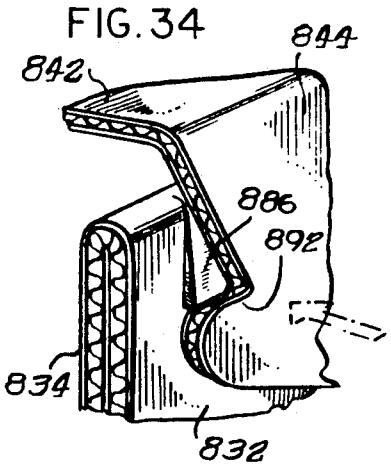
FIG. 34 is a fragmentary perspective view showing locking of the lid members, with the outermost sidewall layer removed.
Figure 33:
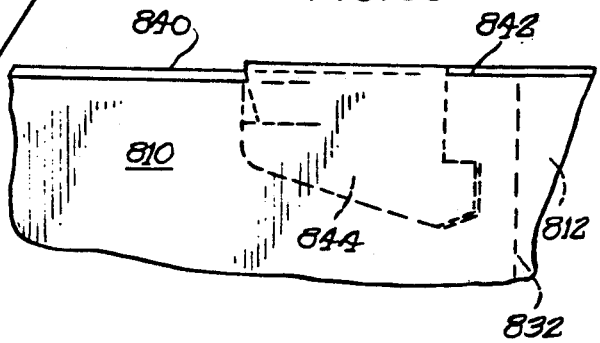

Engagement of the locking tab 886 with locking edge 892 is shown in FIG. 34. Due to the location of locking tab 886 proximate to the fold line joining panels 832, 834, the locking tab springs outwardly as shown in FIG. 34, when the panels 832, 834 are folded one against the other. During insertion of the locking ear 844, the locking tab 886 is momentarily depressed into the plane of side panel 832, but quickly springs out in the manner illustrated in FIG. 34 to lock the forward edge of ear 844. As can be seen in FIGS. 32 and 33, the locking recess 813 closely matches the outer periphery of the locking ear adjacent locking edge 893. In particular, the locking recess 813 includes an upper, generally horizontally extending edge 815 which mates with locking edge 893, thus locking the other end of the locking ear, that end located nearest the hinge line of lid 842. As can now be seen, the locking ear is constrained at its two opposed ends from upward movement, thus maintaining the lids 842, 840 in a closed position and preventing dust intrusion into the carton interior.

To further prevent dust intrusion, the hand holes do not extend completely through the carton sidewalls. As can be seen in FIG. 26, for example, the hand hole formed in side panel 832 is aligned in registry with the hand hole formed in side panel 810, but no hand hole is provided in side panel 834. Thus, the panel 834 is visible through the hand hole in panel 32, as illustrated in FIG. 29. As will be appreciated from studying the carton blank illustrated in FIG. 25, the hand holes on opposite sides of the carton are offset one from another, with the hand holes lying adjacent respective endwall portions.

As can now be seen, the interior sidewall panels overlap one another at generally the mid-portion of each carton side. The interior sidewall panels are interlocked one with another, with a locking post being located generally between endwall 804 and endwall 806. The lid portions overlap one another at a point closer to the opposed endwall 806 and the locking ear of the longer lid 842 engages both intermediate sidewall panels 812 and 832. These multiple, offset locking features have been found to cooperate to provide a very secure locking of the carton, not only of the lid portion, but of the sidewall panels and provide a loading strength necessary for very dense products such as frozen meat products.

As those skilled in the art will appreciate, the carton constructed according to principles of the present inventions provides advantages when assembled on a mass production assembly line. An operator can withdraw a carton blank and with a few simple operations assemble the carton to the position illustrated in FIG. 31, for example, ready to receive product. As part of the fabrication of the carton, the reinforcing beam is folded over into the carton interior and is locked in place with locking ears engaging locking edges formed in the carton endwalls. As will be appreciated, the carton lids 840, 842 may be disturbed during loading of product into the carton interior, and it is important that the locking ears of the reinforcing beam do not become disengaged as the lids are swung back. The locking recesses formed in the end panels, as described above, are spaced from the fold lines which hingedly retain the carton lid members (see FIG. 31, for example). This feature has been found to consistently prevent unlocking of ears 868–870 which would otherwise be caused by buckling of the endwalls were the locking recesses spaced closer to the fold line joining the hinge member to its adjacent endwall panel.

As can now be seen, a carton having a triple layer sidewall is provided from a single integral carton blank. A reinforcing beam adds a fourth layer to the upper portion of the sidewall, without extending to the carton bottom. As another important feature, outward forces directed generally normal to the plane of the carton sides are constrained. For example, the interior sidewalls have their abutting seam enclosed by outer sidewall 810 at the outside of the carton, and reinforcing beam 852 on the inside of the carton. Similarly, the locking ear 844 is confined against outward movement by outside sidewall 810. These features contribute to the integrity of the several interlocking features of the carton. As can now be appreciated by studying FIG. 25, these numerous features are provided in a carton blank formed with cut portions which are simple in configuration, generally either straight-line portions or right-angle portions, which contribute to the longevity of the cutting die used to form the carton blank. Further, as can now be seen herein, the tolerances associated with forming the cutting blank with cut lines and score lines is not particularly critical to the successful performance of the carton interlocking features, an important feature for a mass produced carton.

Figure 36:
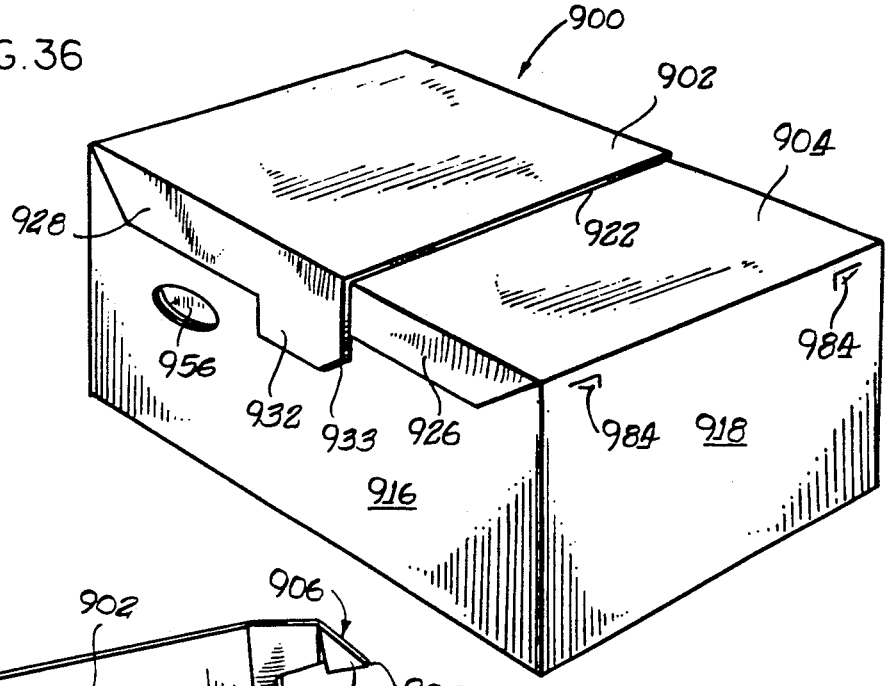
FIG. 36 is a perspective view of another carton constructed according to principles of the present invention.

Turning now to FIG. 36, an alternative embodiment of a carton constructed according to principles of the present invention, will now be described. Carton 900 has sidewall constructions generally similar to the carton of FIGS. 25–35. The carton 900 also has a pair of partially overlapping lid members 902, 904. As will be seen herein, carton 900 has an improved locking for the lid members which includes folded locking members 906 carried on lid 902 (see FIG. 36).

Figure 38:
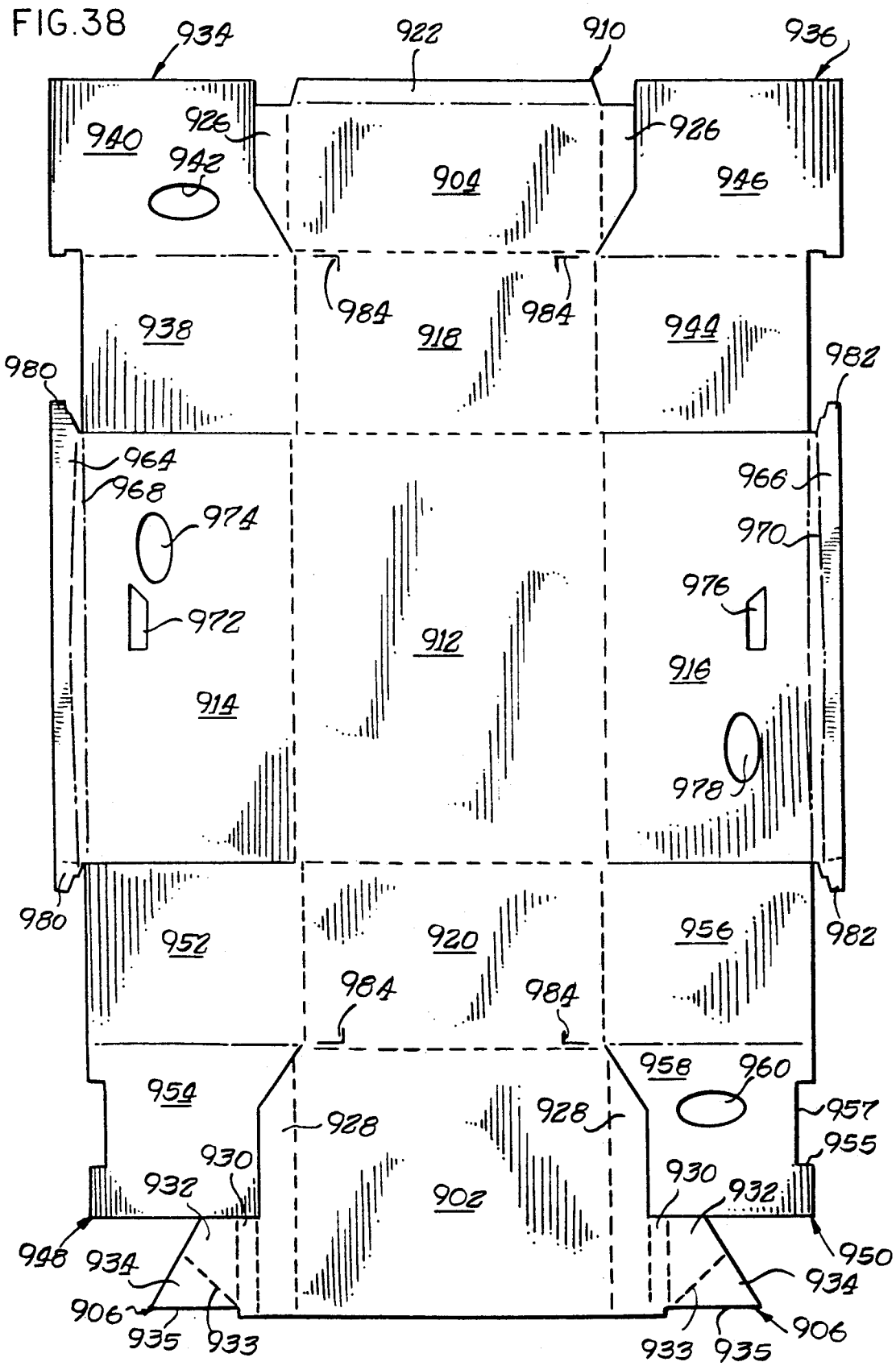
FIG. 38 is a plan view of a carton blank from which the carton of FIGS. 36-37 is constructed.

Referring now to FIG. 38, carton 900 is constructed from a one-piece blank generally indicated at 910. Blank 910 includes a floor panel 912, outer side panels 914, 916 and endwall panels 918, 920. Lid members 902, 904 are hingedly connected to endwalls 920, 918, respectively. A dust flap 922 is hingedly connected to the outer end of lid panel 904. Dust flaps 926 extend from the sides of lid panel 904.

Dust flaps 928 extend from the sides of lid panel 902 and are connected through panels 930 to folded locking ears generally indicated at 906. The locking ears comprise a first panel 932 and a second, generally triangular panel 934.

Sidewall subassemblies are located at each corner of blank 910. For example, sidewall subassemblies 935, 936 extend from opposite sides of endwall 918. Sidewall subassembly 935 includes an inner sidewall panel 938 and an intermediate sidewall panel 940. Intermediate sidewall panel 940 defines an oval hand hole 942. Sidewall subassembly 936 includes an intermediate panel 946 and an inner side panel 944. In a similar manner, sidewall subassemblies 948, 950 are hingedly connected to opposite sides of end panel 920. Sidewall subassembly 948 includes an inner sidewall panel 952 and an intermediate sidewall panel 954. Sidewall subassembly 950 includes an inner sidewall panel 956 and an intermediate sidewall panel 958 having a hand hole 960 formed therein.

As can be seen from FIG. 38, the inner sidewall panels 938, 944, 952 and 956 have similar configurations, but the intermediate panels of the various sidewall subassemblies differ somewhat, although the intermediate sidewall panels associated with a particular endwall panel are generally mirror images of one another (except for the formation of a hand hole).

Reinforcing beams 964, 966 are connected through panels 968, 970 to respective outer sidewall panels 914, 916, respectively. Outer sidewall panel 914 has a locking aperture 972 and a hand hole 974 formed therein. The other outer sidewall panel 916 has a locking aperture 976 and a hand hole 978 formed therein.

Reinforcing beam 964 has stepped locking ears 980 formed at each end thereof, and reinforcing beam 966 has stepped locking ears 982 formed at each end thereof. The stepped locking ears mate with recessed edges 984 formed by generally L-shaped cuts in the upper corners of each end panel, as described above with reference to the carton of FIGS. 25–35.

Figure 39:
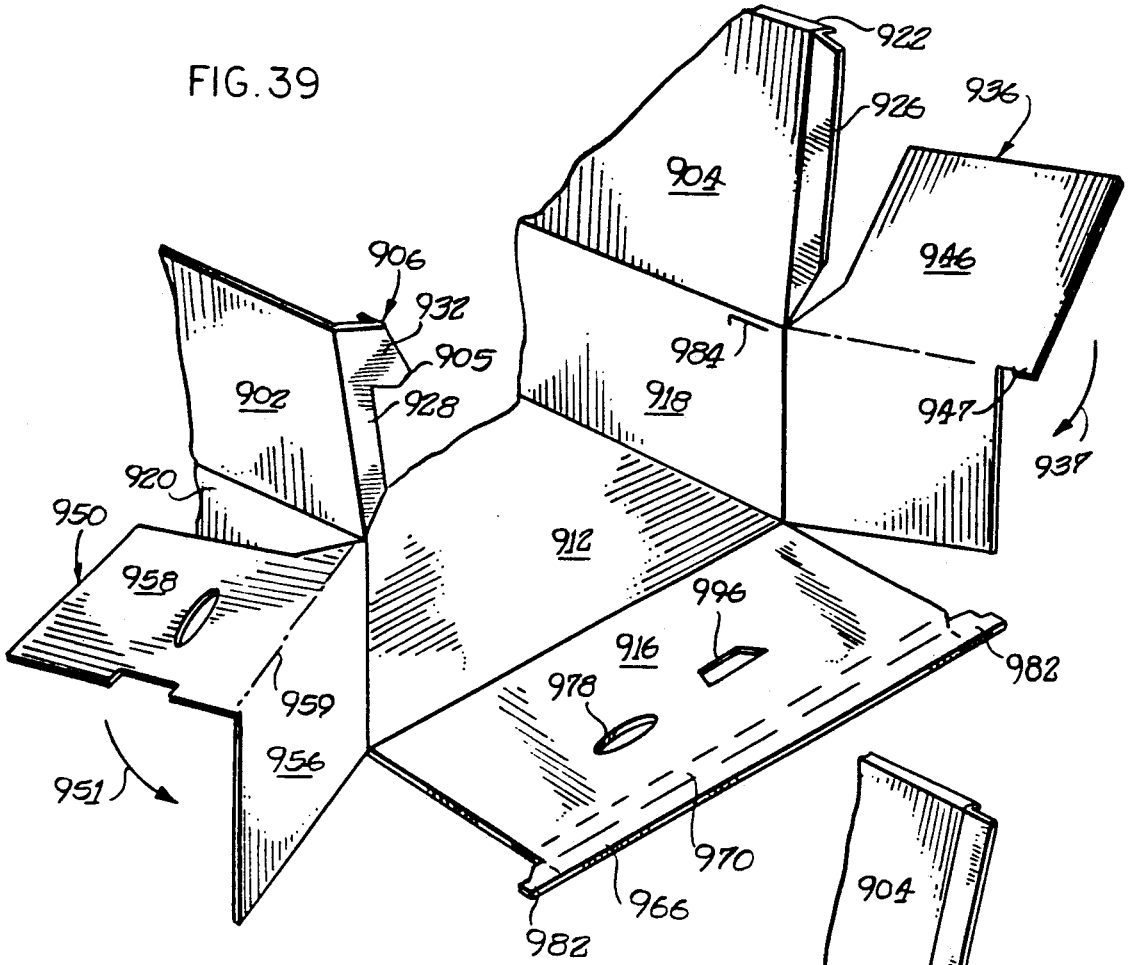
FIGS. 39-41 are fragmentary perspective views showing the construction of the carton.
Figure 40:
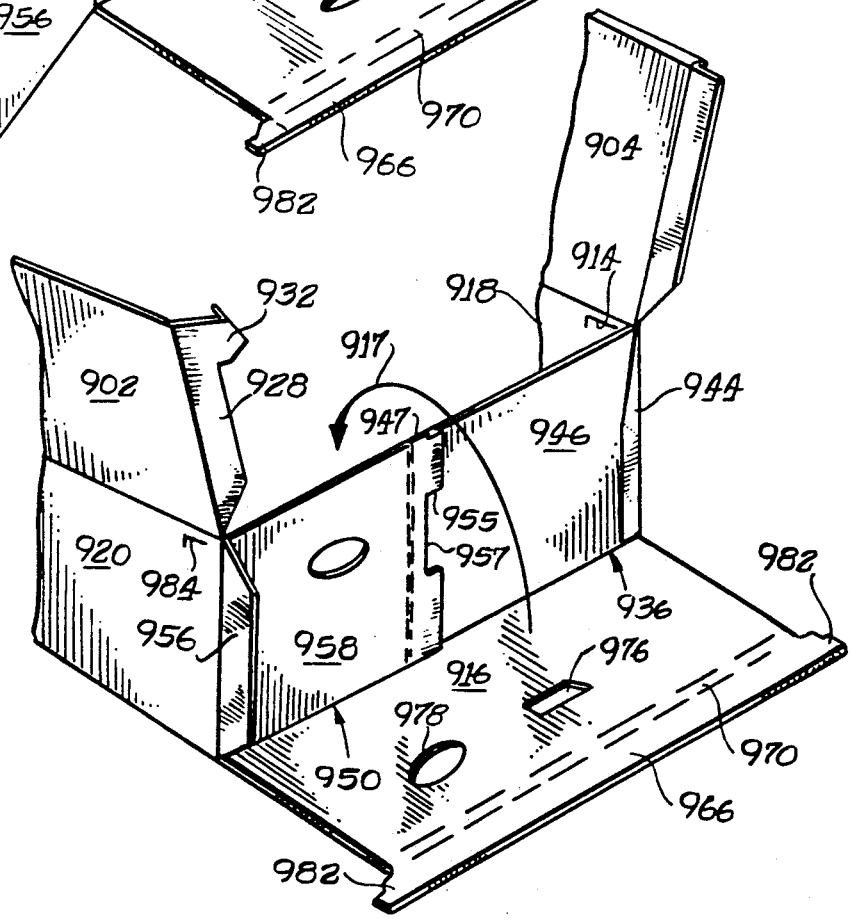

Referring now to FIGS. 39–43, erection of the carton 900 will be described. As shown in FIG. 39, endwalls 918, 920 are bent in generally vertical directions, at right angles to floor panel 912. Thereafter, the sidewall subassemblies 936, 950 are swung in the direction of arrows 937, 951, respectively. As described above with the preceding alternative carton constructions, intermediate sidewall panel 946 carries a locking post 947 and a slot 959 is formed along the fold line joining panels 958, 956. The sidewall panels 936, 950 are locked together in the manner illustrated in FIG. 40 with locking posts 946 received in slot 959. Thereafter, the outer sidewall panel 916 is swung in the direction of arrow 917, so as to contact the interlocked sidewall assemblies. As can be seen in FIG. 40, for example, intermediate sidewall panel 958 overlies intermediate sidewall panel 946 and includes a stepped edge 957 with an upper locking edge 955, which is lined in registry with locking aperture 976, when the outer sidewall 916 is raised to its locked position.

Figure 37:
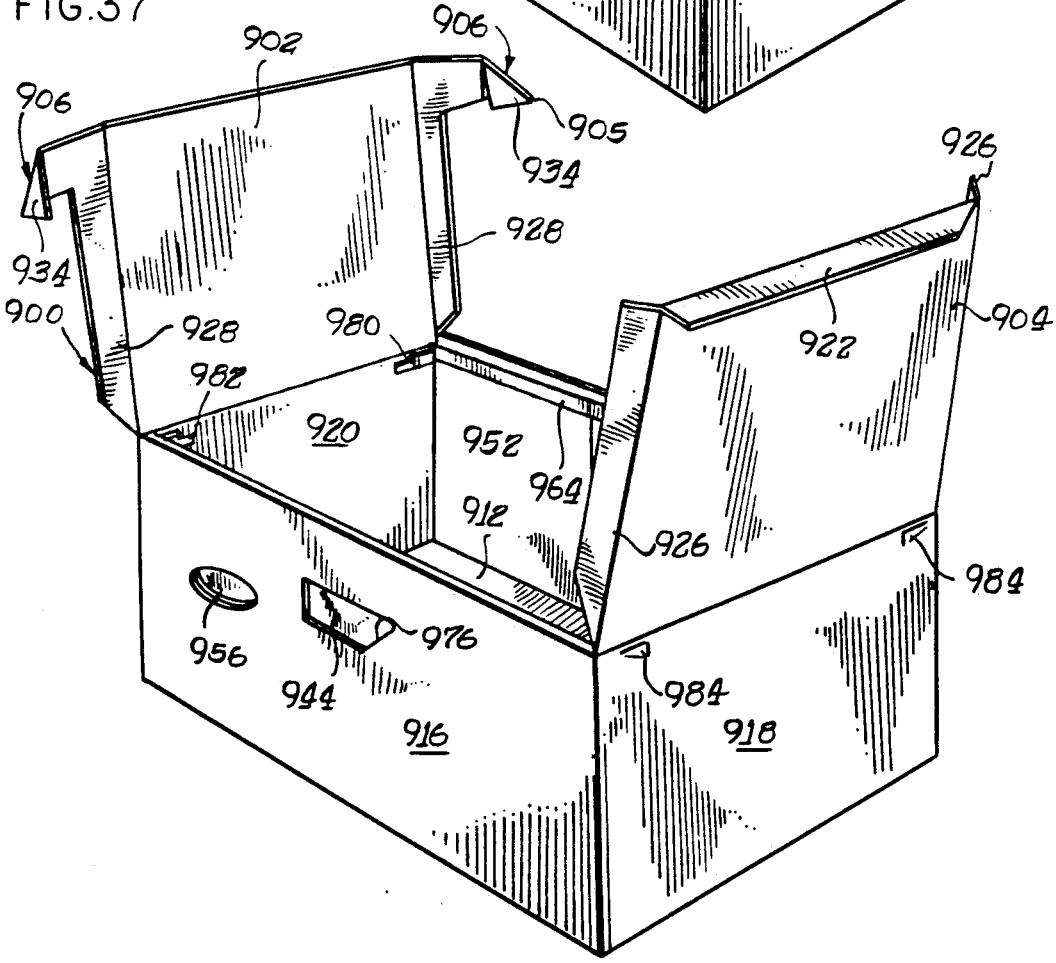
FIG. 37 is a perspective view of the carton of FIG. 36, with the lid panels in an open position.

With reference again to FIG. 40, it can be seen that portions of inner sidewalls 944, 956 are visible, adjacent end panels 918, 920, respectively. The removal of sidewall material at these locations is necessary for the dust flaps formed with the lid members, and does not detract from the strength of the triple-thickness sidewalls in part, because the intermediate sidewall panels 946, 958 are not cut away at the uppermost edge of the carton sidewall, thus providing a continuous support to a stand compression forces when the cartons are stacked one on top of another, for example. The reinforcing beams are folded over the top of the sidewall subassemblies and the stepped locking ears are brought into engagement with the locking edges formed in the carton end panels, as illustrated in FIG. 37.

Figure 41:
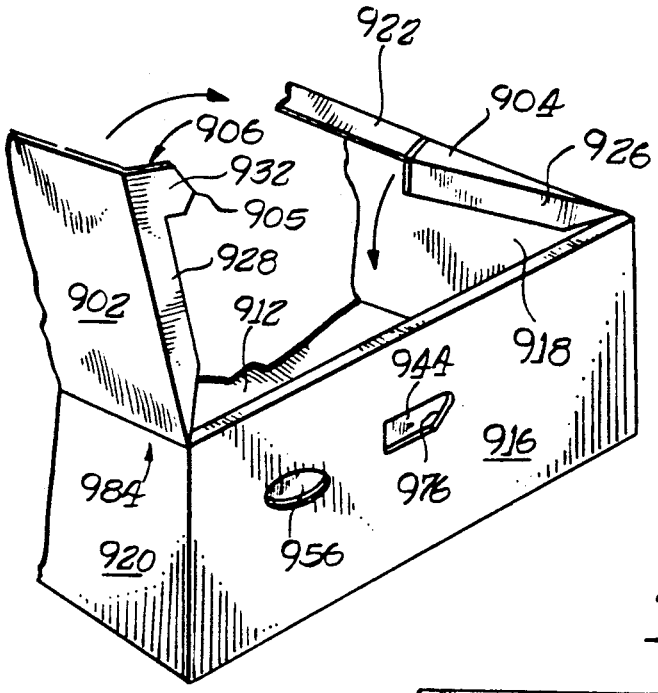
Figure 43:
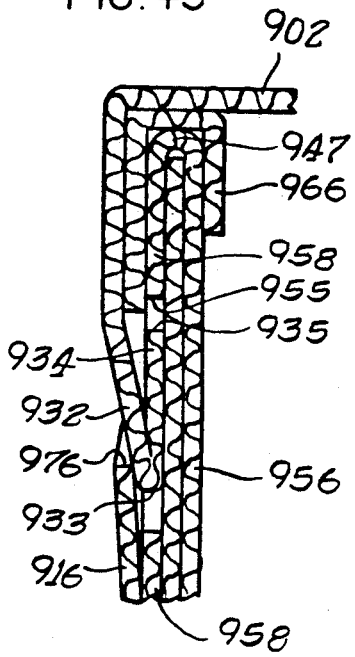
FIG. 43 is a fragmentary cross-sectional view taken along the line 43—43 of FIG. 42.

Referring now to FIG. 41, dust flap 922 is folded back as carton lid 904 is lowered into the closed position. Thereafter, carton lid 902 is lowered in position and when fully closed pushes dust flap 922 back against lid panel 904 to thereby form an effective dust seal at the overlapping joinders of the lid panels.

Figure 42:
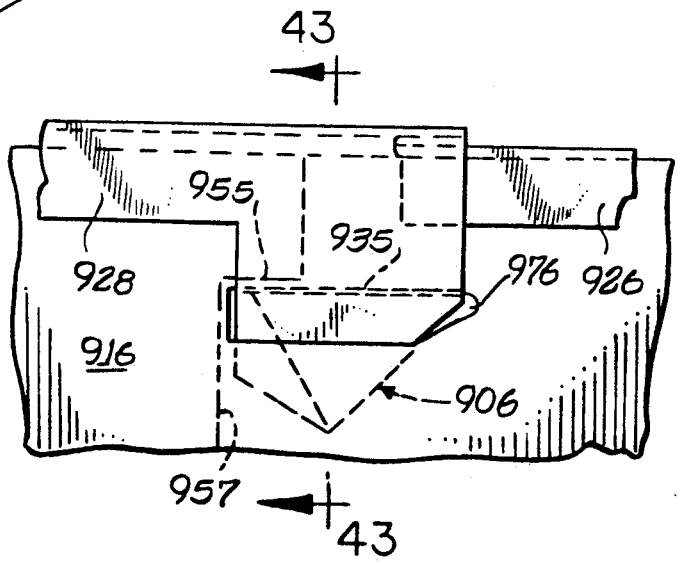
FIG. 42 is a fragmentary side elevational view showing the carton in a fully constructed and locked position.

According to one aspect of the present invention, a line of weakness 933 is formed between the portions 932, 934 of the foldable locking ear 906 (see FIG. 38), allowing the triangular portions 934 to be folded back upon the first portions 932, in the manner illustrated in FIG. 42. Thereafter, as the lid panel 902 is lowered into a closed position, the free end of the folded locking ears is inserted in the locking aperture 976. The lower or leading end of the folded locking ear slips between the outer and intermediate side panels, bringing the locking edge 935 of the locking ear into contact with the locking edge 955. Preferably, the line of weakness 933 comprises a single, relatively narrow score line such that a bias force is created when the locking ear portions are folded over one on the other, tending to separate the locking ear portions. Thus, the triangular locking ear portion 934 is biased for inward movement toward the carton interior, the first locking ear portion 932 being constrained against outward movement by the outer sidewall panel 916.

As can be seen in FIG. 41, for example, the lower end 905 of the folded locking tab 906 is pointed to further enhance insertion through aperture 976, between the intermediate and outer sidewall panels. As can be seen in FIG. 40, for example, the locking edge 955 is generally aligned with the interlocking joinder of the sidewall subassemblies, as can be seen with reference to the locking post 947, illustrated in FIG. 40. The partial overlapping of the lid panels and sidewall subassemblies is located at or very near the point of locking of the folded locking tab and locking edge 955, thus concentrating the inherent reinforcement of the carton construction at a point where it is needed most. Further, as those skilled in the art will appreciate, the reinforcement immediately adjacent the locking edges prevents movement or play in the various interengaging carton components which would weaken the carton components, perhaps reducing their effective life.

As mentioned above, material has been removed from portions of the intermediate sidewalls, as can be seen in FIG. 40, for example. This materials is used for the side flaps 926, 928 to prevent dust intrusion into the carton interior. Further, a dust flap 922 is provided to further prevent dust intrusion, and as mentioned, the hand holes in the carton sides are blocked by the inner wall panel members. These features are particularly important when the cartons are used for transport of food products, without requiring expensive individual wrapping of the food product items disposed within a carton.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have bee employed, they are intended in a generic and descriptive sense only and not for the purposes of limitation, the scope of the invention being delineated by the following Claims.

What is claimed is:

1. Carton apparatus having triple layer sidewall means, formed from a one-piece blank, comprising:

a floor panel having two pairs of opposed sides;

a pair of opposed endwall panels hingedly connected to one pair of opposed sides of said floor panel, the endwall panels each having opposed sides;

lid panels in serial succession with said end wall panels and said floor panel and hingedly connected to said endwall panels along hinge lines;

a pair of outer sidewall panels hingedly connected to the remaining pair of opposed sides of said floor panel;

a sidewall subassembly coupled to each side of said endwall panels, with pairs of sidewall subassemblies overlain by a respective outer sidewall panel, each sidewall subassembly comprising hingedly connected inner and intermediate side wall panels, with one of said inner and said intermediate side wall panels of each subassembly hingedly connected to a side of a respective end wall panel; and means for interlocking engagement of each pair of adjacent sidewall subassemblies which are overlain by a common outside wall panel.

2. The carton apparatus of claim 1 wherein said interlocking means comprises at least one locking post on one said sidewall subassembly and at least one post-receiving slot defined by the other sidewall subassembly.

3. Carton apparatus having triple layer sidewall means, formed form a one-piece blank, comprising:

a floor panel having two pairs of opposed sides;

a pair of opposed endwall panels hingedly connected to one pair of opposed sides of said floor panel, the endwall panels each having opposed sides;

lid panels in serial succession with said end wall panels and said floor panel and hingedly connected to said endwall panels along hinge lines;

a pair of outer sidewall panels hingedly connected to the remaining pair of opposed sides of said floor panel;

a sidewall subassembly coupled to each side of said endwall panels, each sidewall subassembly comprising hingedly connected inner and intermediate side wall panels, with one of said inner and said intermediate side wall panels of each subassembly hingedly connected to a side of a respective end wall panel;

reinforcing beam means hingedly connected to said outer sidewall panels, extending between opposed sides of each said endwall panel, to reinforce the upper edges thereof, said reinforcing beam means elongated along a longitudinal axis extending generally parallel to said outer sidewall panel;

locking ears at each end of said reinforcing beam means, extending along the longitudinal axis thereof, said endwalls including locking ear engaging means for engaging said locking ears; and means for interlocking engagement of adjacent sidewall subassemblies which are overlain by a common outside wall panel to form sidewall means of said carton.

4. The carton apparatus of claim 3 wherein said interlocking means comprises at least one locking post on one said sidewall subassembly and at least one post-receiving slot defined by the other sidewall subassembly.

5. Carton apparatus having triple layer sidewall means, formed from a one-piece blank, comprising:

a floor panel having two pairs of opposed sides;

a pair of opposed endwall panels hingedly connected to one pair of opposed sides of said floor panel, the endwall panels each having opposed sides;

lid panels in serial succession with said end wall panels and said floor panel and hingedly connected to said endwall panels along hinge lines;

a pair of outer sidewall panels hingedly connected to the remaining pair of opposed sides of said floor panel; and a sidewall subassembly coupled to each side of said endwall panels, each sidewall subassembly comprising hingedly connected inner and intermediate side wall panels, with one of said inner and said intermediate side wall panels of each subassembly hingedly connected to a respective end wall panel side;

a pair of locking tabs depending from the overlying lid panel free end portion, said locking tabs being generally rectangular and folded into first and second generally triangular portions;

locking tab engaging means on at least one of said inner, intermediate and outer sidewall panels, for engaging said locking tabs to hold said lid panels in a closed position enclosing the carton interior, said locking tab engaging means comprising slots defined in the outer sidewall panels for receiving the locking tabs and for guiding the locking tabs between the outer and intermediate side walls, the locking tab engaging means further comprising recesses formed in edges of the intermediate sidewalls, the recesses defined at least in part by respective locking edges, and the locking tabs comprise first and second portions folded against one another, the second portions including locking edges engageable with the locking edges of the intermediate sidewalls.

6. A one-piece blank foldable to produce a carton having triple layer sidewall means, comprising:

a floor panel having two pairs of opposed sides;

a pair of outer sidewall panels having hand hole portions defining hand holes;

means for hingedly connecting the outer sidewall panels to opposed sides of said floor panel;

endwall panels hingedly connected to a second pair of opposed sides of said floor panel;

lid panels in serial succession with said end wall panels and said floor panel;

inner side wall panels extending from opposed sides of each said endwall panel;

intermediate side wall panels coupled to said inner side wall panels, with said intermediate sidewall panels located between said inner side and said outer side wall panels;

hinge walls means coupled said intermediate side and inner side panels together; and reinforcing beam means;

coupling means for hingedly coupling said reinforcing beam means to said outer sidewall means so as to partially overlie said inner sidewall means for reinforcement thereof when folded thereupon, said coupling means comprising an alternating series of hinge walls and cut lines, said cut lines forming guide posts on either side thereof, so that, when the reinforcing beam means is folded over upon the intermediate sidewall means, said guide posts are spaced apart to form an opening therebetween.

7. The blank of claim 6 wherein one said lid defines a pair of apertures for receiving a locking tab therethrough and the other lid includes a pair of locking tabs for insertion through said apertures to enter between the guide posts, reinforcing means joined to the intermediate sidewall means and cooperating therewith to define a slot for receiving said locking tab means therein.

8. Carton apparatus having triple layer sidewall means, formed from a one-piece blank, comprising:

a floor panel having two pairs of opposed sides;

a pair of opposed endwall panels hingedly connected to one pair of opposed sides of said floor panel, the endwall panels each having opposed sides;

lid panels in serial succession with said end wall panels and said floor panel and hingedly connected to said endwall panels along hinge lines;

a pair of outer sidewall panels hingedly connected to the remaining pair of opposed sides of said floor panel; and a sidewall subassembly coupled to each side of said endwall panels, each sidewall subassembly comprising hingedly connected inner and intermediate side wall panels, with one of said inner and said intermediate side wall panels of each subsassembly hingedly connected to a respective end wall panel side;

a pair of locking tabs depending from the overlying lid panel free end portion, the locking tabs comprising first and second portions folded against one another, the second portions including locking edges engageable with the locking edges of the intermediate sidewalls; and locking tab engaging means including recesses formed in edges of the intermediate sidewalls, the recesses defined at least in part by respective locking edges for engaging said locking tabs to hold said lid panels in a closed position enclosing the carton interior; and said outer sidewall panels defining slots for receiving the locking tabs and for guiding the locking tabs between the outer and intermediate side walls.

* * * * *

UNITED STATES PATENT AND TRADEMARK OFFICE

CERTIFICATE OF CORRECTION

PATENT NO. : 5,125,567

DATED : June 30, 1992

INVENTOR(S) : Jack A. McClure

It is certified that error appears in the above-identified patent and that said Letters Patent is hereby corrected as shown below:

In Column 8, line 10, after the word "The" delete the second occurrence of the word "the"; and after the word "of" insert --the--.

In Column 10, line 15, after the numeral "816" insert a period --.--.

In Column 16, line 23, change "bee" to read --been--.

In Column 18, line 15 (Claim 6, line 18) change the word "coupled" to read --coupling--.

Signed and Sealed this

Thirty-first Day of August, 1993

Bruce Lehman

*Attest:*

BRUCE LEHMAN

*Attesting Officer*

*Commissioner of Patents and Trademarks*